US007062936B2

(12) United States Patent
Rand et al.

(10) Patent No.: US 7,062,936 B2
(45) Date of Patent: Jun. 20, 2006

(54) CLEAR ICE MAKING REFRIGERATOR

(75) Inventors: Thomas W. Rand, Cedarburg, WI (US); Andrew J. Doberstein, Hartford, WI (US); Joseph H. Zyduck, Mukwonago, WI (US)

(73) Assignee: U-Line Corporation, Milwaukee, WI (US)

( * ) Notice: Subject to any disclaimer, the term of this patent is extended or adjusted under 35 U.S.C. 154(b) by 138 days.

(21) Appl. No.: 10/719,353

(22) Filed: Nov. 21, 2003

(65) Prior Publication Data

US 2005/0109056 A1 May 26, 2005

(51) Int. Cl.
*F25C 1/12* (2006.01)

(52) U.S. Cl. ..... 62/347; 62/352; 62/441

(58) Field of Classification Search ..... 62/198, 62/347, 348, 352, 441, 442
See application file for complete search history.

(56) References Cited

U.S. PATENT DOCUMENTS 2,866,322 A * 12/1958 Muffly ..... 62/137
3,433,030 A * 3/1969 Jacobs ..... 62/186
4,416,119 A * 11/1983 Wilson et al. ..... 62/149
4,872,317 A 10/1989 Reed
4,918,936 A * 4/1990 Sakamoto ..... 62/117
5,125,242 A 6/1992 von Blanquet
5,127,236 A 7/1992 von Blanquet
5,375,432 A * 12/1994 Cur ..... 62/320
5,406,805 A * 4/1995 Radermacher et al. ..... 62/81
5,553,457 A * 9/1996 Reznikov ..... 62/81
5,586,439 A 12/1996 Schlosser et al.
6,058,731 A 5/2000 Byczynski
6,148,621 A 11/2000 Byczynski et al.
6,148,633 A * 11/2000 Yamada et al. ..... 62/347
6,351,959 B1 * 3/2002 Hirota ..... 62/198
6,438,978 B1 * 8/2002 Bessler ..... 62/179
6,679,073 B1 * 1/2004 Hu ..... 62/135

* cited by examiner

*Primary Examiner*—William E. Tapolcai
(74) *Attorney, Agent, or Firm*—Quarles & Brady LLP

(57) ABSTRACT

A compact refrigerator has a split cabinet defining insulated refrigerator and clear ice maker sections. Its refrigeration system includes one external compressor and condenser and two evaporators, one for each section. The condenser is coupled to the inlet of the ice maker evaporator by a capillary tube and the evaporators are connected in series via a line having a refrigerator valve. The compressor receives return refrigerant from the outlet side of either the refrigerator evaporator or the ice maker evaporator depending on the state of a bypass valve, which is closed when the refrigerator valve is open, and vice versa. Refrigerant is thus routed to the ice maker evaporator to make ice and to both the ice maker and refrigerator evaporators when the refrigerator needs cooling. A hot gas bypass valve allows pre-condensed refrigerant exiting the compressor to bypass the condenser and be routed to the ice maker evaporator for harvesting the clear ice cubes.

27 Claims, 19 Drawing Sheets

FIG. 8
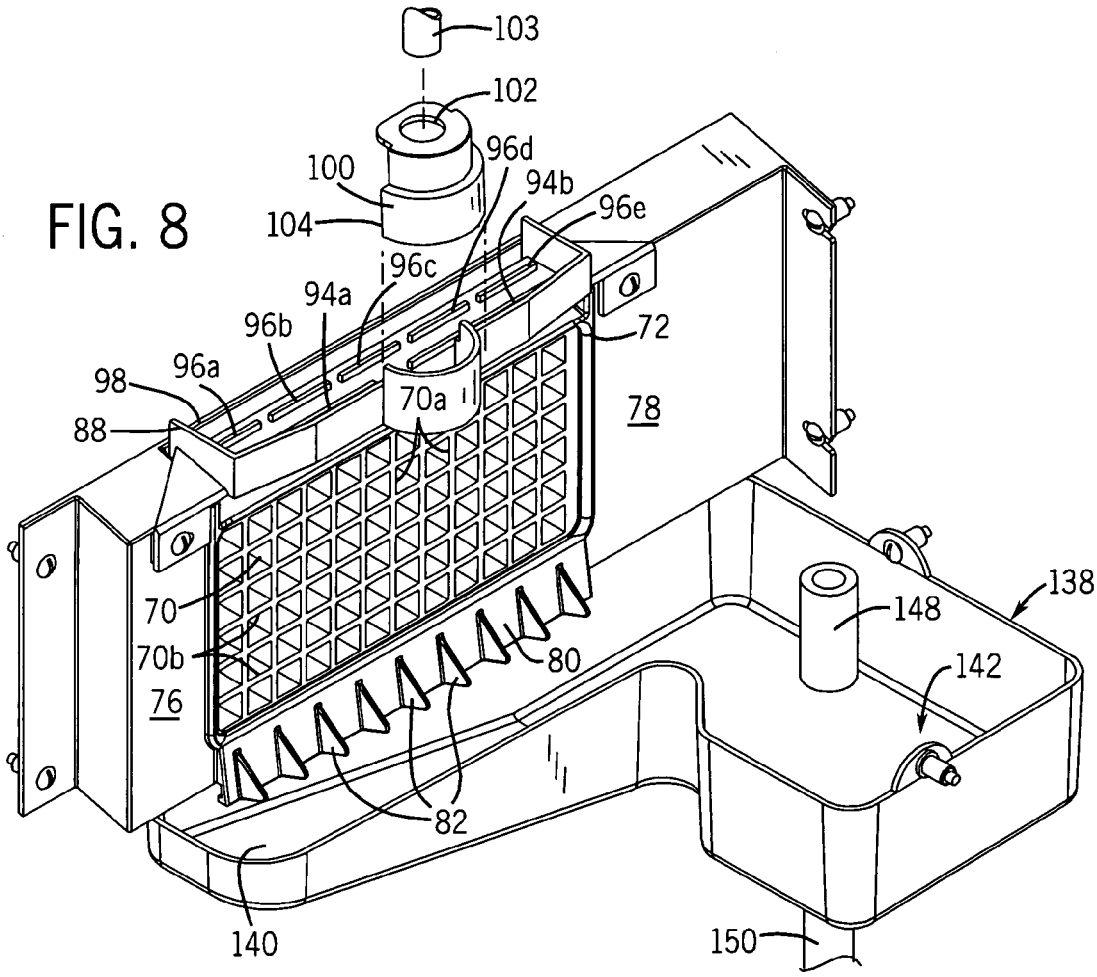
FIG. 9
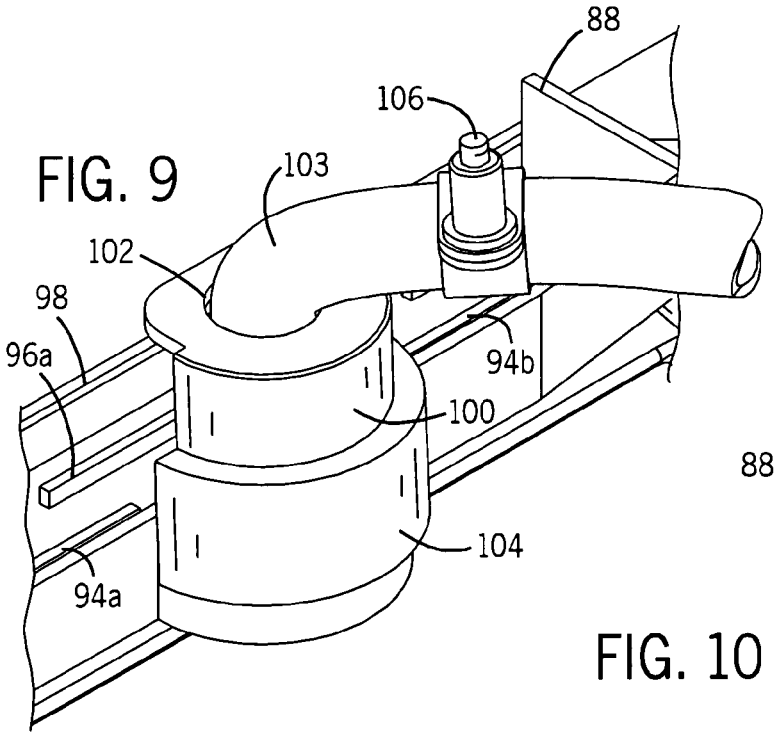
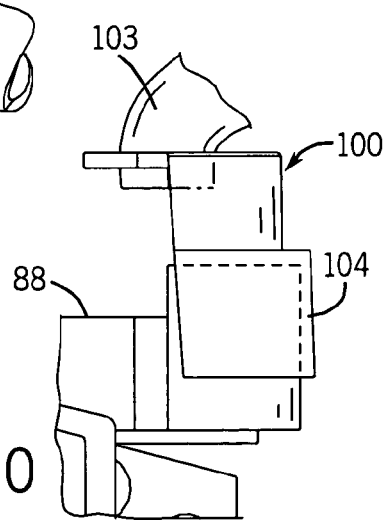
FIG. 10

MODE: WATER FILL WITH REFRIGERATION REQUIRED
(NOTE: NORMAL START-UP WITH A WARM REFRIGERATOR)

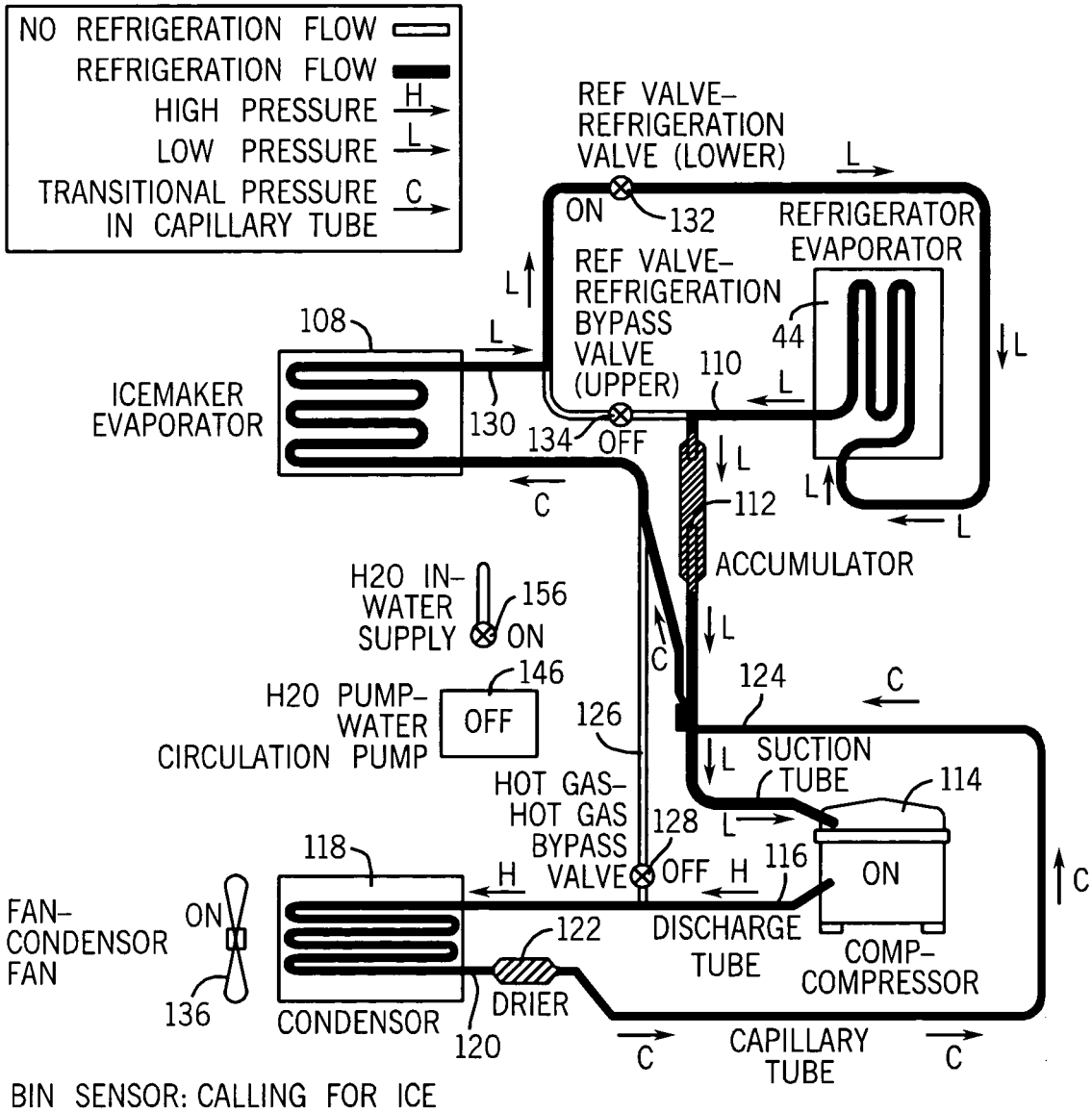

BIN SENSOR: CALLING FOR ICE
REFRIGERATOR SENSOR: CALLING FOR COOLING
LIQUID LINE SENSOR: NOT APPLICABLE

| RELAY | COMP | H20 IN | REF VALVE* | FAN | H20 PUMP | HOT GAS |
|---|---|---|---|---|---|---|
| STATUS | ON | ON | ON | ON | OFF | OFF |

*DOUBLE THROW RELAY: OFF: REF VALVE CLOSED, REF BY-PASS VALVE OPEN

NOTE: THE REFRIGERATOR WILL CONTINUE TO RUN UNTIL THE COMPLETION OF THE THREE MINUTE FILL CYCLE REGARDLESS OF THE REFRIGERATOR SENSOR

FIG. 13

MODE: WATER FILL– NO REFRIGERATION REQUIRED

| RELAY | COMP | H20 IN | REF VALVE* | FAN | H20 PUMP | HOT GAS |
|---|---|---|---|---|---|---|
| STATUS | OFF | ON | OFF | OFF | OFF | OFF |

*DOUBLE THROW RELAY: OFF: REF VALVE CLOSED, REF BY-PASS VALVE OPEN

MODE: ICE MAKING AND REFRIGERATION

BIN SENSOR: CALLING FOR ICE
REFRIGERATOR SENSOR: CALLING FOR COOLING
LIQUID LINE SENSOR: DETERMINES LENGTH OF ICE CYCLE & HARVEST

| RELAY | COMP | H20 IN | REF VALVE* | FAN | H20 PUMP | HOT GAS |
|---|---|---|---|---|---|---|
| STATUS | ON | OFF | ON | ON | ON | OFF |

*DOUBLE THROW RELAY: ON: REF VALVE OPEN, REF BY-PASS VALVE CLOSED

MODE: ICE MAKING AND NO REFRIGERATION

BIN SENSOR: CALLING FOR ICE
REFRIGERATOR SENSOR: SATISFIED (NO CALL FOR COOLING)
LIQUID LINE SENSOR: DETERMINES LENGTH OF ICE CYCLE & HARVEST

| RELAY | COMP | H20 IN | REF VALVE* | FAN | H20 PUMP | HOT GAS |
|---|---|---|---|---|---|---|
| STATUS | ON | OFF | OFF | ON | ON | OFF |

*DOUBLE THROW RELAY: OFF: REF VALVE CLOSED, REF BY-PASS VALVE OPEN

MODE: REFRIGERATION AND NO ICE MAKING

BIN SENSOR: SATISFIED-BIN FULL
REFRIGERATOR SENSOR: CALLING FOR COOLING
LIQUID LINE SENSOR: NOT APPLICABLE

| RELAY | COMP | H20 IN | REF VALVE* | FAN | H20 PUMP | HOT GAS |
|---|---|---|---|---|---|---|
| STATUS | ON | OFF | ON | ON | OFF | OFF |

*DOUBLE THROW RELAY: OFF: REF VALVE CLOSED, REF BY-PASS VALVE OPEN

MODE: ICE HARVEST (NO REFRIGERATION POSSIBLE)

LIQUID LINE SENSOR: DETERMINES LENGTH OF ICE CYCLE & HARVEST

| RELAY | COMP | H20 IN | REF VALVE* | FAN | H20 PUMP | HOT GAS |
|---|---|---|---|---|---|---|
| STATUS | ON | ON | OFF | OFF | OFF | ON |

*DOUBLE THROW RELAY: OFF: REF VALVE CLOSED, REF BY-PASS VALVE OPEN

MODE: ALL SATISFIED

BIN SENSOR: BIN FULL
REFRIGERATOR SENSOR: SATISFIED (NO CALL FOR COOLING)
LIQUID LINE SENSOR: NOT APPLICABLE

| RELAY | COMP | H20 IN | REF VALVE* | FAN | H20 PUMP | HOT GAS |
|---|---|---|---|---|---|---|
| STATUS | OFF | OFF | OFF | OFF | OFF | OFF |

*DOUBLE THROW RELAY: OFF REF VALVE CLOSED, REF BY-PASS VALVE OPEN

MODE: CLEANING (NO REFRIGERATION POSSIBLE)

| RELAY | COMP | H20 IN | REF VALVE* | FAN | H20 PUMP | HOT GAS |
|---|---|---|---|---|---|---|
| STATUS | OFF | ON / OFF | OFF | OFF | OFF / ON | OFF |

*DOUBLE THROW RELAY: OFF REF VALVE CLOSED, REF BY-PASS VALVE OPEN

CLEAR ICE MAKING REFRIGERATOR

BACKGROUND OF THE INVENTION

1. Technical Field

The present invention relates to refrigerators and clear ice makers.

2. Description of the Related Art

Refrigerators and coolers for the cold storage of food and beverage items are well known. Typical residential ice makers form ice cubes by depositing water into a mold attached to an evaporator or the freezer compartment and allowing the water to freeze in a sedentary state. Such an approach results in clouded ice cubes as a result of the entrapped air and impurities in the water.

It is known that forming ice by flowing water over a freezing surface will eliminate the clouding associated with sedentary freezing. Such a flowing water process has typically been used in commercial ice cube makers. One example of the flowing water approach is shown in U.S. Pat. No. 5,586,439; this patent and all others mentioned herein are hereby incorporated by reference as though fully set forth herein. In this patent, water is flowed over a vertically disposed evaporator plate whose surface defines pockets. The water cascades over the surfaces of the pockets and an ice cube is formed in each pocket. The ice cubes are harvested by passing hot vaporous refrigerant through the evaporator in place of the cold refrigerant. The resulting ice cubes are nearly transparent and not cloudy due to the particulate contaminates in the water being heavier than the water and falling from the evaporator before freezing and forming part of the ice cube. U.S. Pat. Nos. 6,058,731 and 6,148,621 disclose compact clear ice maker units incorporating such cascading water evaporator plates.

These machines are separate from conventional full-size or compact refrigerators. It is well known for the freezer sections of some of these conventional refrigerators to include ice makers of the regular, non-clear, variety. U.S. Pat. No. 4,872,317 shows and describes a refrigeration unit having a built-in conventional type ice maker. As is conventional, this patented unit includes a molded tray type ice maker in the freezer section of the unit with a mechanical actuator to dispense and harvest the ice. Such ice makers are used in conventional refrigeration units because they are self contained, needing only a water supply line, and because they can produce ice in a unit having only one evaporator that cools both the freezer and refrigerator compartments.

SUMMARY OF THE INVENTION

The present invention is combination refrigerator and clear ice maker, preferably of the compact, under-counter type. The invention provides a single refrigeration unit having a divided cabinet with a refrigerator side and a clear ice making side incorporating a flowing water system for producing clear ice, wherein each side has a dedicated evaporator. "Clear ice" is a common and accepted term in the refrigeration industry which is generally used to refer to ice formed in layers without the entrapped air, mineral and other particulates common in tap water which have a tendency to cause odor and to cloud the water when frozen.

Specifically, the invention provides a refrigerator with clear ice making capability including a cabinet defining an interior refrigerator chamber and an interior ice maker chamber isolated from the refrigerator chamber by a partition wall. A clear ice maker mechanism is disposed in the ice maker chamber and includes an evaporator plate defining a plurality of pockets over which water cascades and in which clear ice pieces are formed. A refrigeration system includes an ice maker evaporator disposed in the ice maker chamber adjacent the evaporator plate and a refrigerator evaporator disposed in the refrigerator chamber. The evaporators are coupled to a compressor receiving return refrigerant from the evaporators and to a condenser coupled to the compressor.

In a preferred form, the cabinet has a front opening leading to the ice maker chamber and the refrigerator chamber that is closed by a door hinged to the cabinet along one side. The door has a special seal designed to extend along the front face of the cabinet, along the top, bottom, side and partition walls. An insulated body in the ice maker chamber defines an ice bin receiving harvested ice pieces from the ice maker mechanism. The seal has a small cross-piece that seals off an opening to the insulated body in the ice maker chamber when the door is closed. The seal thus isolates the ice from the ambient and the heat from the refrigeration system in the uninsulated compartment of the refrigerator by preventing hot air from passing between the door and an uninsulated lower panel in the front of the ice maker chamber (where the user control is mounted) and into the opening of the insulated body.

Preferably, the evaporator plate has a plurality of spaced vertical members and a plurality of spaced horizontal members intersecting the vertical members at right angles to define the pockets. The horizontal members extend downwardly from a rear edge to a front edge at an oblique angle to so that water flowing onto the evaporator plate can cascade down the evaporator plate and so that the ice cubes can drop under gravity from the evaporator plate when harvested. A water distributor is disposed above the evaporator plate for distributing water over the full width of the evaporator plate so as to run over all of the pockets therein. An end of a water tube is mounted to the center of the distributor by a tube retainer havening an opening and an inverted partial cup section mating with a centering section of the distributor.

The water tube provides fresh water supply and runs from a water sump mounted in the ice maker chamber beneath the evaporator plate in which is disposed a water pump circulating water from the sump through the water tube back to the ice maker evaporator plate. An overflow mechanism is also provided that is connected to a drain leading out of the cabinet. The overflow drain can be connected to an optional condensate or waste drain pump and overflow collector having two floats, one disposed vertically above the other. The lower float operates a switch to activate the drain pump to drain the overflow collector and the upper float can disrupt the ice maker capability and activate an indicator light in the event the drain line backs up. The indicator light preferably stays on until power to the refrigerator is disrupted, which is intended to provide the user or field technician indication of a prior or current error condition.

In an even more preferred form, the evaporators are connected in series, and the refrigerator evaporator receives refrigerant passing through the ice maker evaporator. A refrigerator valve controls flow of refrigerant from the ice maker evaporator to the refrigerator evaporator, and a bypass valve controls flow of refrigerant from the ice maker to the compressor when the refrigerant valve is closed. These valves are preferably solenoid operated and electronically controlled so that during operation of the refrigerator at least one of the valves is open while being interlocked so that both of the valves cannot be open or closed concurrently.

In other preferred forms, another bypass valve is disposed between an outlet side of the compressor and the inlet side of the ice maker evaporator so that when open it routes pre-condensed (hot) refrigerant from the compressor to the ice maker evaporator and bypasses the condenser. This hot gas bypass valve is closed during normal operation of the refrigerator and is opened during an ice harvest cycle so as to warm the evaporator plate slightly to melt the interface between the ice cubes and the evaporator plate so that they can be dispensed into the ice bin.

The refrigerator of the present invention has an electronically controlled refrigeration system operating automatically according to temperature readings taken from temperature sensors located at various locations in the cabinet, including at the ice bin, the refrigerator and a liquid refrigerant line, to operate in one of four primary modes in addition to an inactive state, water fill modes and a cleaning mode. In particular, if, based on the temperature readings, cooling is needed in the refrigerator section and more ice is needed in the ice bin, then the system operates in a dual cooling mode in which the circulation pump is energized to supply water to the ice maker evaporator plate and the refrigerator valve is opened (and the refrigerator bypass valve is closed) so that refrigerant is supplied to the ice maker evaporator and the refrigerator evaporator. When the ice maker bin temperature is within the set range, but the refrigerator section needs cooling, the system enters refrigeration only mode in which the refrigerator and refrigerator bypass valves stay the same as the dual cooling mode so that refrigerant is supplied to the ice maker evaporator and the refrigerator evaporator, however, the water pump is not energized so that water does not flow to the ice maker evaporator plate. No ice is formed then, but additional cooling will occur in the ice maker chamber as a result of the refrigerant flow through the ice maker evaporator, but this is acceptable given that only ice is stored or formed in this chamber. In an ice making only mode, the refrigerator valve is closed and the bypass valve is opened so that refrigerant is supplied to the ice maker evaporator, but not to the refrigerator evaporator. The water pump is also energized to run water over the ice maker evaporator plate, preferably for a time period determined according to the liquid refrigerant line temperature sensor. In an ice harvest mode, the hot bypass valve is opened to divert away from the condenser the hot pre-condensed refrigerant from the compressor to the ice maker evaporator. This warms the ice maker evaporator plate and causes melting at the interface of the ice cubes to allow them to drop down into the ice bin. As mentioned, the refrigeration system can also be in inactive in which the compressor and condenser are not operating so that no refrigerant is supplied to either the ice maker evaporator or the refrigerator evaporator. The unit can be switched to a cleaning mode in which the ice maker water pump and water fill valve are energized alternately to fill and pump water over the ice maker evaporator plate without condensed refrigerant in the ice maker evaporator.

These and still other advantages of the invention will be apparent from the detailed description and drawings. What follows is a preferred embodiment of the present invention. To assess the full scope of the invention the claims should be looked to as the preferred embodiment is not intended as the only embodiment within the scope of the invention.

BRIEF DESCRIPTION OF THE DRAWINGS

FIG. 8 is a perspective view of the clear ice maker;

FIG. 9 is a partial enlarged view of a water tube retainer attaching a water tube to a distributor section of the clear ice maker;

FIG. 10 is a partial front view showing the water tube retainer;

FIG. 13 is a schematic diagram of the refrigeration system for the refrigerator when in a water fill mode and when refrigeration and ice are required;

DETAILED DESCRIPTION OF THE PREFERRED EMBODIMENT

Figure 1:
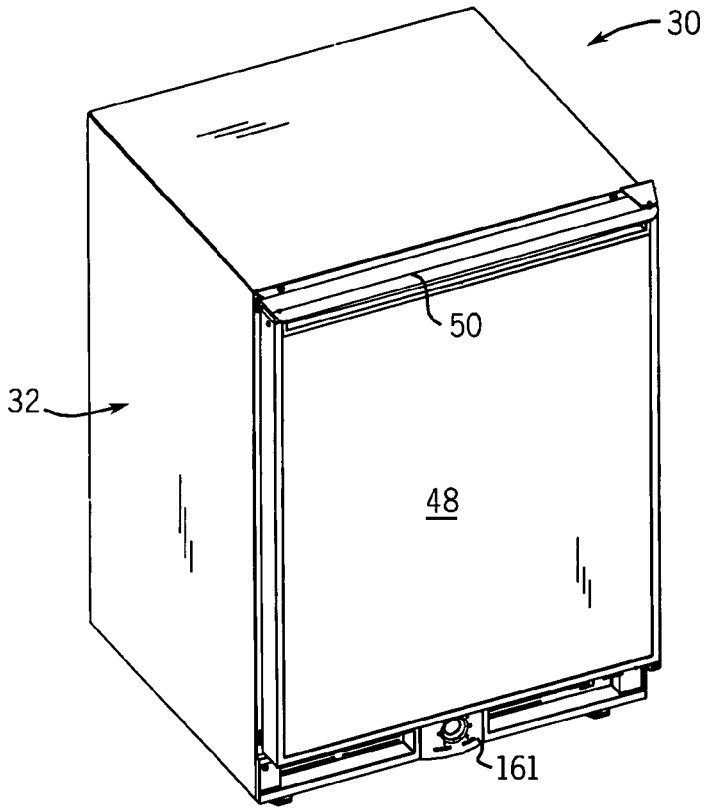
FIG. 1 is a perspective view of the compact combination refrigerator and clear ice maker unit of the present invention.
Figure 2:
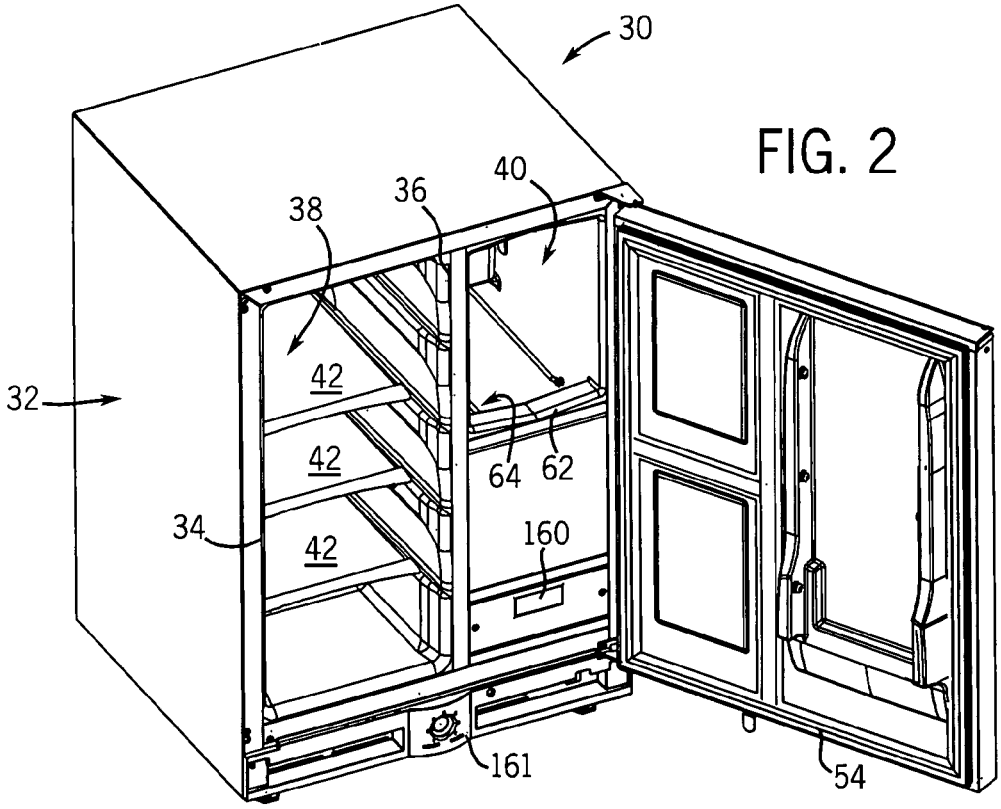
FIG. 2 is a perspective view thereof showing a front door opened.
Figure 3:
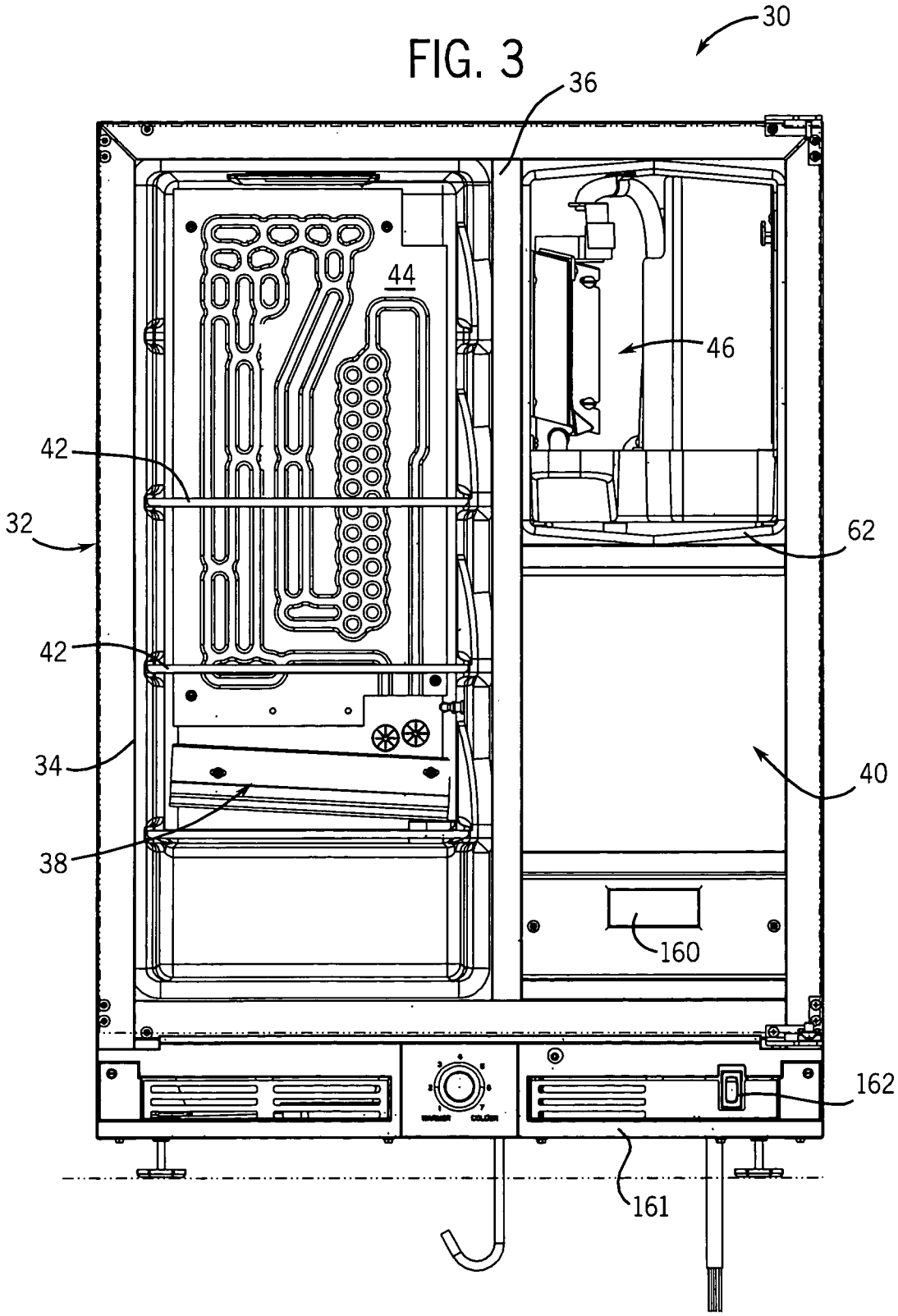
FIG. 3 is a front plan view thereof of shown with the front door removed.

Referring to FIGS. 1–6, a combination refrigerator and clear ice maker 30 ("combination unit 30") includes a cabinet 32 defining a cavity with a forward opening 34 that is divided by a partition wall 36 into a refrigerator section 38 and an ice section 40. The refrigerator section 38 is simply a rectangular chamber, preferably providing about 2.5 cubic feet of cool storage space, with pairs of vertically spaced grooves for supporting edge encapsulated glass panel shelves 42. Along the back wall of the refrigerator section 38 is a thin refrigerator evaporator 44 with internal refrigerant passages, which is part of the refrigeration system of the combination unit 30, discussed below. The ice section 40 is a similarly sized chamber having a foam insulated, molded insert 45 containing a clear ice maker assembly 46 and defining an access opening 62 and a lower ice storage bin 64 (see FIG. 5D).

Figure 5A:
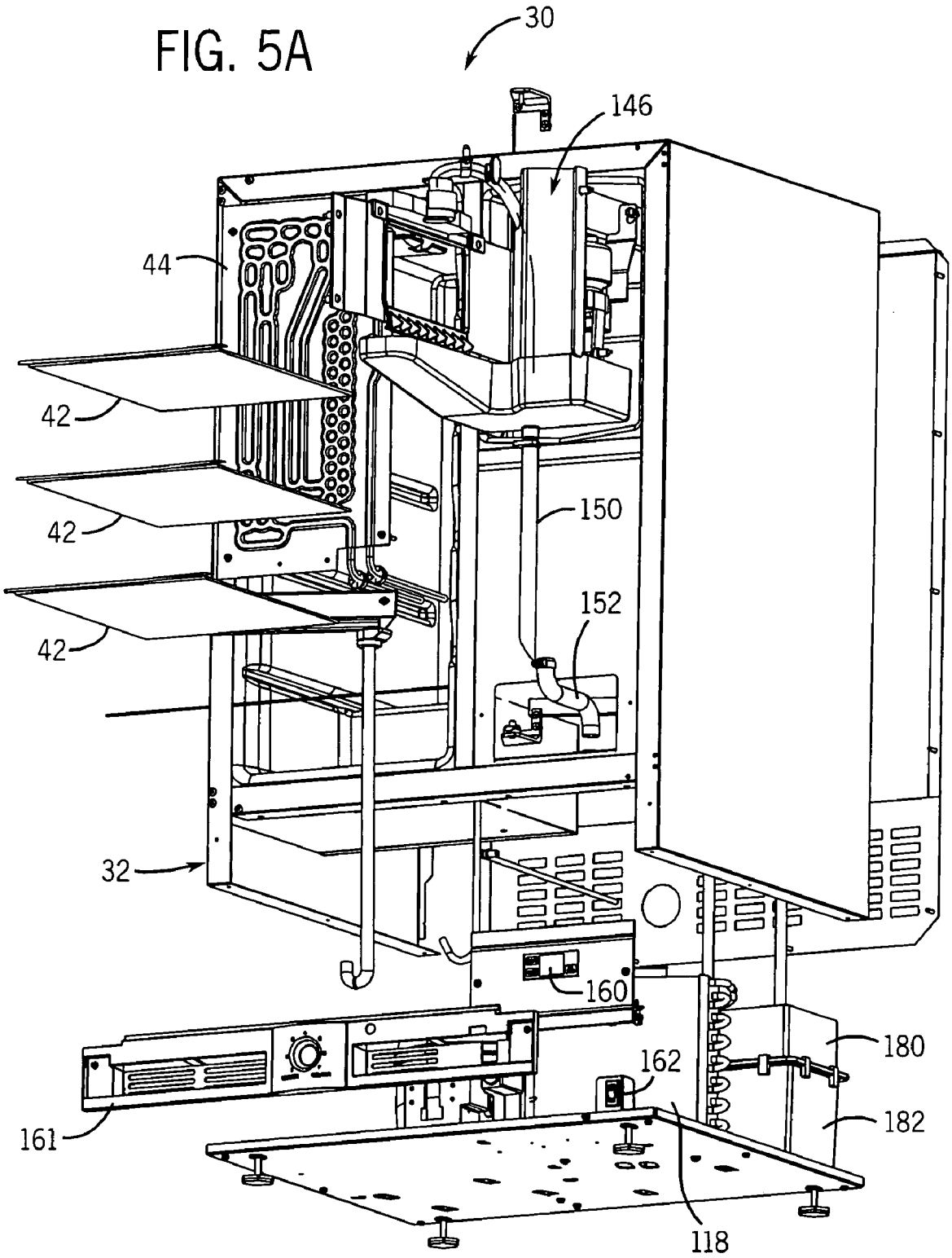
FIG. 5A is an exploded perspective view of the unit without the door.
Figure 5B:
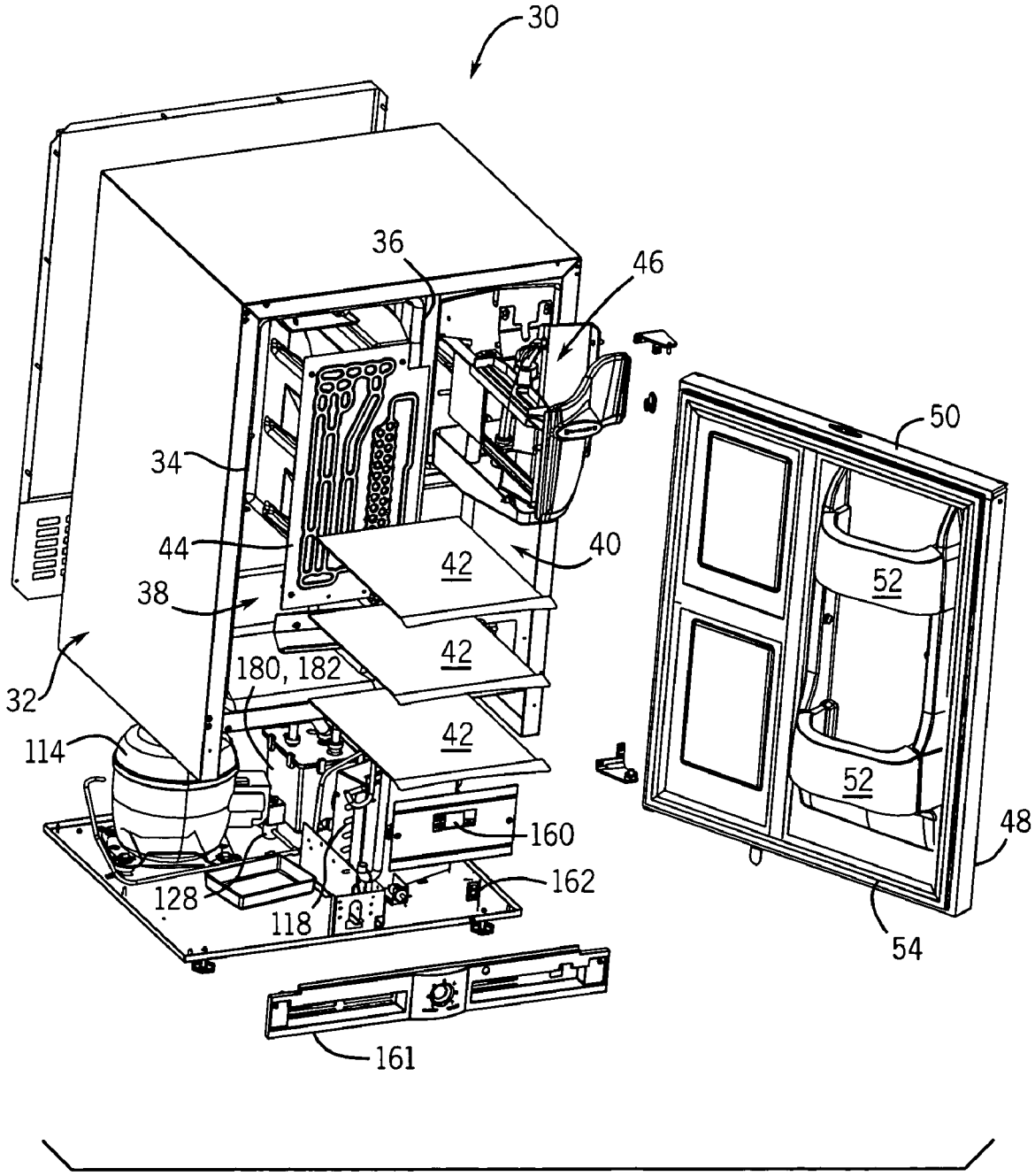
FIG. 5B is another exploded perspective view of the unit.
Figure 6:
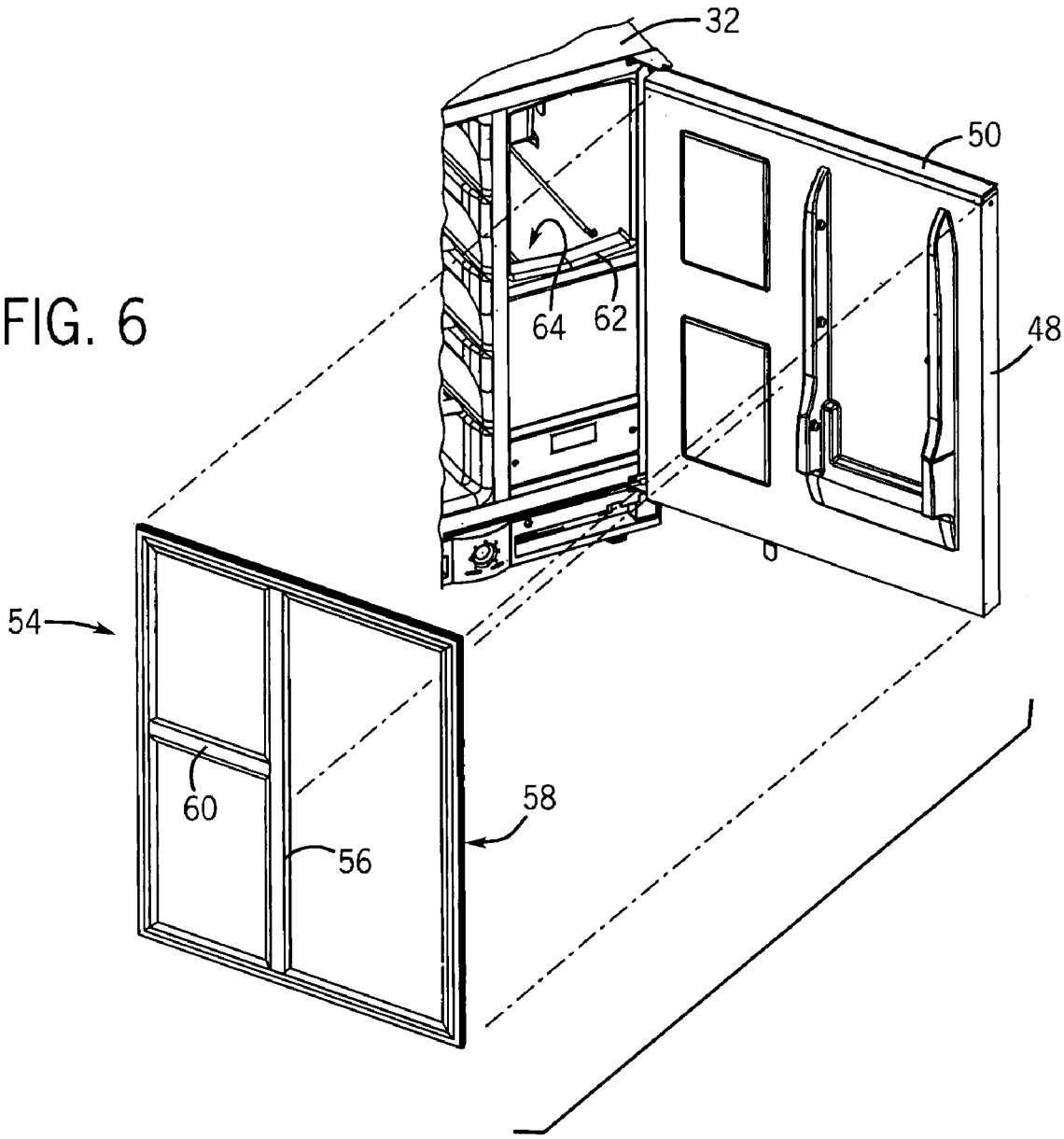
FIG. 6 is a partial perspective view showing a special door seal.

The cabinet opening 34 is closed by a door 48 that is hinged to the cabinet 32 (with self-closing cams) along one vertical side thereof. Both the cabinet 32 and door 48 are formed of inner molded plastic members and outer formed metal members with the space filled with an insulating layer of foam material, all of which is well known in the art. The door 48 has a full-width handle 50 along a top edge of a special construction to allow the door to accept an overlay panel (not shown) matching the cabinetry where the unit is installed. Details of such an overlay panel and a preferred handle construction can be found in co-owned pending application Ser. No. 10/076,746, filed on Feb. 14, 2002. As shown in FIGS. 5B and 6, the inside of the door 48 can have one or more door shelves 52, and vertical supports therefor preferably being formed as an part of the molded plastic interior of the door 48. A wrap around front and bottom portion of the shelves 52 is preferably removable from the door 48 so that the containers or other items stored thereon can be transported by the removable portion of the shelves 52.

A rubber accordion type refrigerator gasket 54 is mounted to the inside of the door 48 to thermally isolate the refrigerator section 38 and the ice section 40 from each other and the ambient exterior to the combination unit 30 when the door 48 is closed against the cabinet 32. The gasket 54 is specially configured with a vertical segment 56 near the horizontal center of a rectangular frame 58 so as to seat against the front edge of the partition wall 36, in addition to the frame 58 seating against the front edges of the top, bottom and side walls of the cabinet 32, when the door 46 is closed. The gasket 54 also has a shorter horizontal cross segment 60 that seats against a front panel of the ice section behind which is the insulated insert 45 (and ice bin 64) containing clear ice pieces harvested from the clear ice maker assembly 46.

Figure 5C:
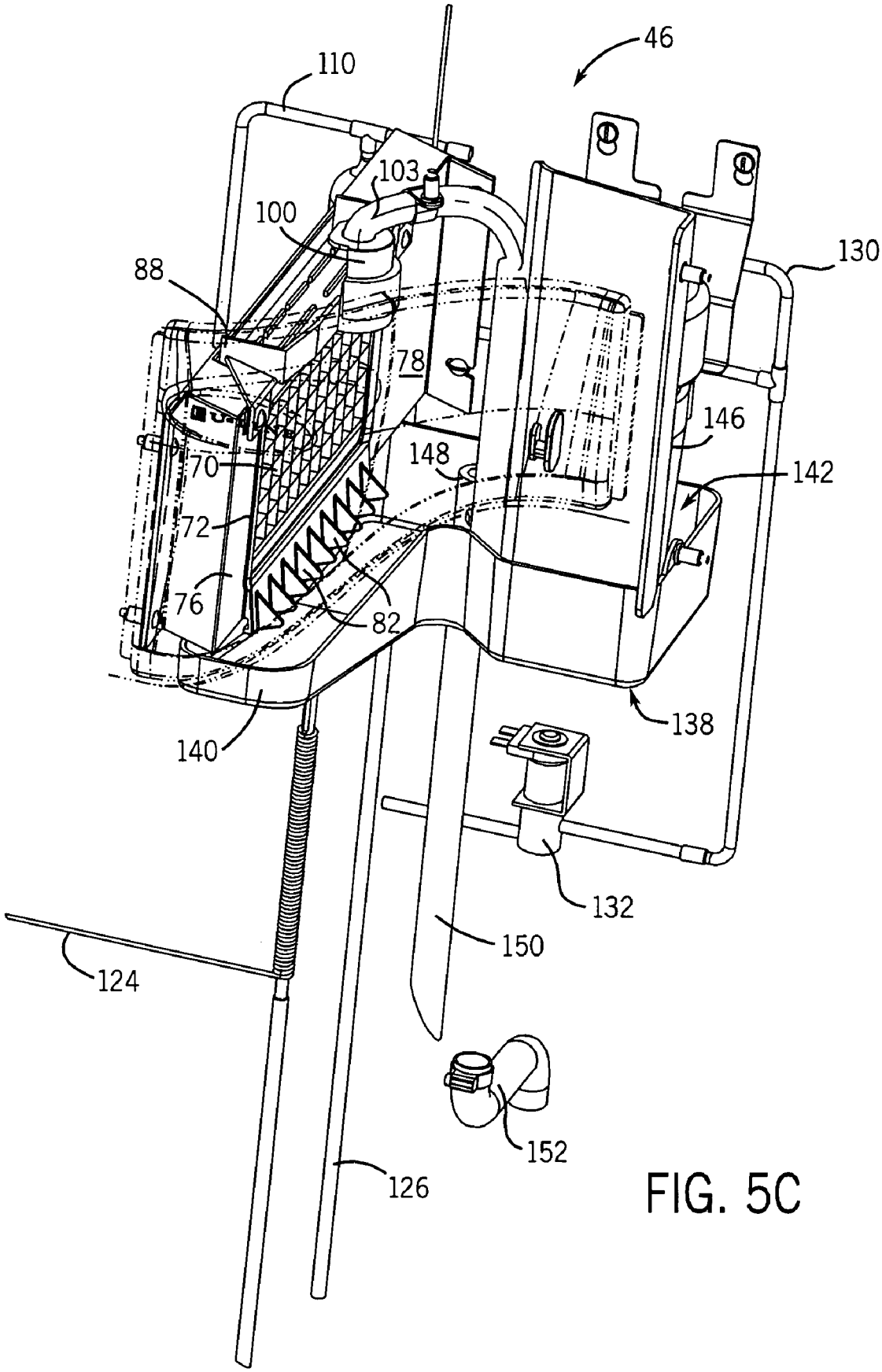
FIG. 5C is a perspective view of a clear ice maker mechanism.
Figure 5D:
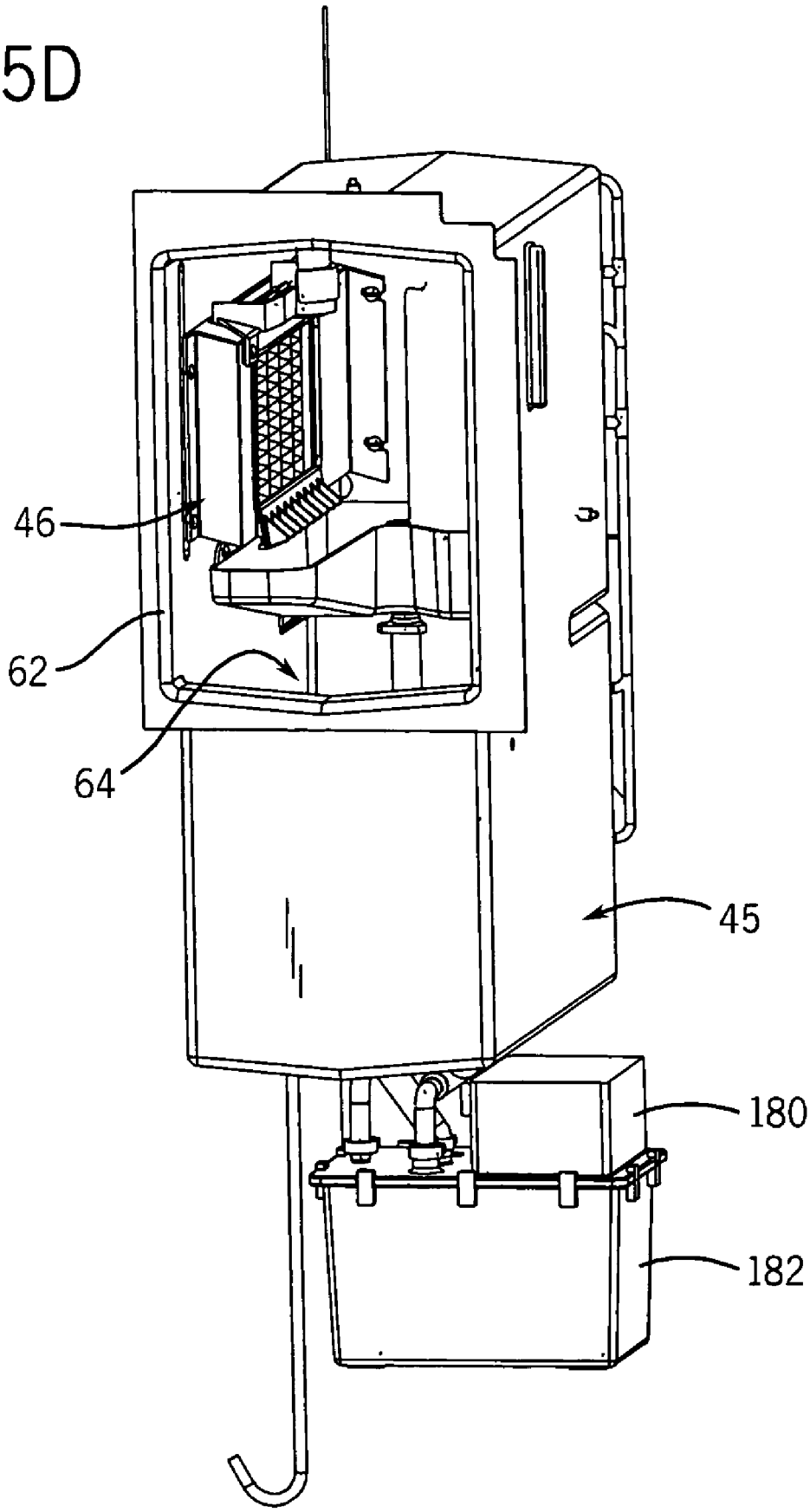
FIG. 5D is a perspective view showing the insulated interior insert of the ice maker section of the unit.
Figure 7:
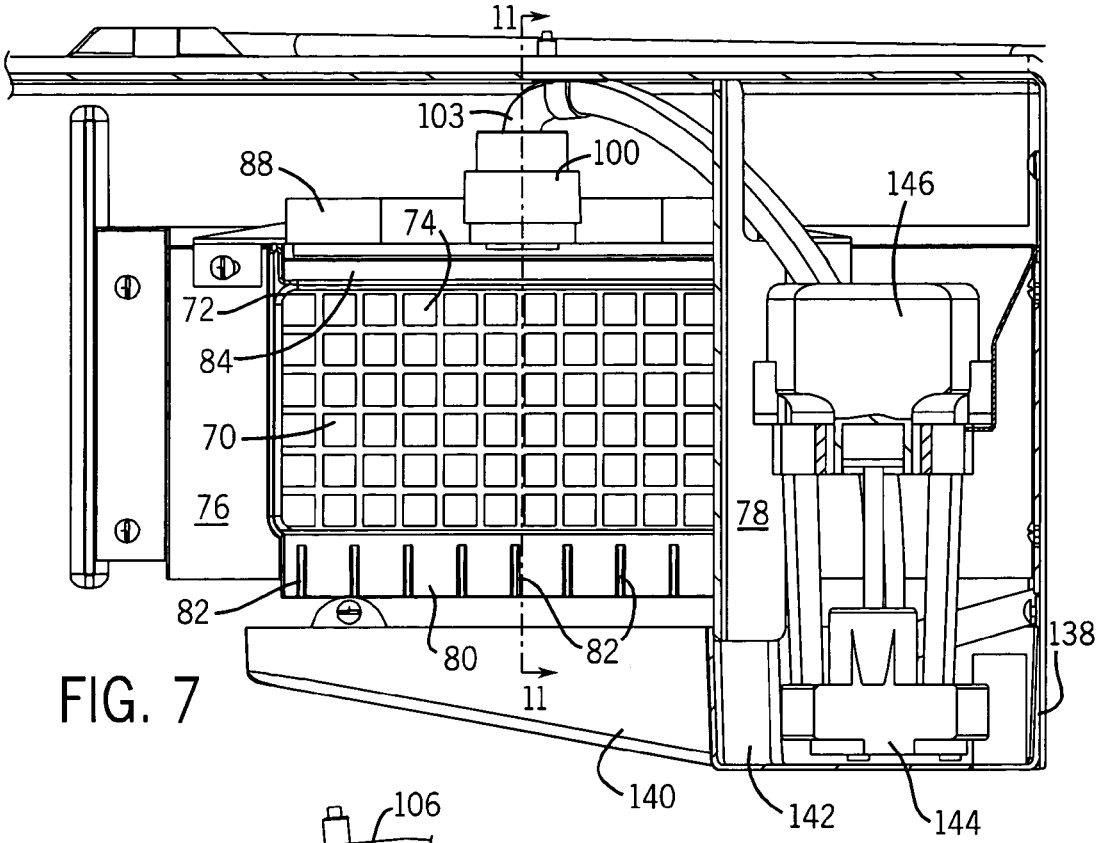
FIG. 7 is an enlarged view of the clear ice maker.

Referring now to FIGS. 5C and 7–8, the clear ice maker assembly 46 is riveted to the partition wall 36 in the upper part of the ice section 40 of the cabinet 32. The clear ice maker assembly 46 includes a metal evaporator grid 70 mounted in a plastic shroud 72. The evaporator grid 70 has a series of vertical and horizontal dividers 70*a* and 70*b*, respectively, which extend from a rear wall 74 and between lateral edges to divide the evaporator grid 70 into a series of pockets. As best shown in FIGS. 7 and 8, the horizontal dividers 70*b* slope towards the bottom front of the evaporator grid 70.

Figure 11:
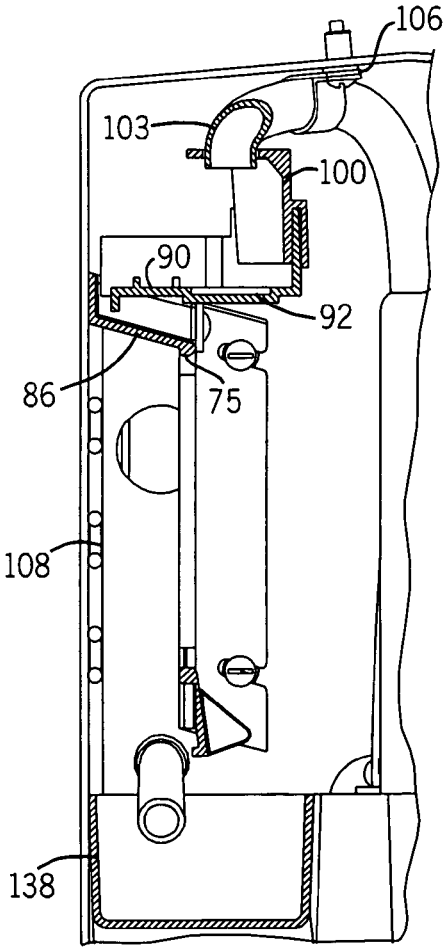
FIG. 11 is a partial cross-sectional view taken along line 11—11 of FIG. 7.
Figure 12:
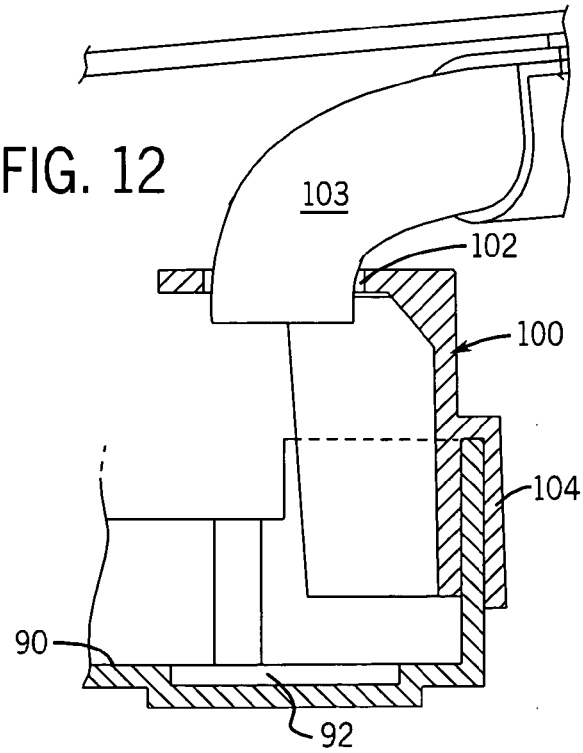
FIG. 12 is an enlarged section view of the water tube retainer.

The shroud 72 is formed of a plastic material such as a polypropylene or ABS and is molded about the evaporator grid 70. The shroud 72 has a continuous bulbous edge 75 (see FIG. 11) which engulfs the edges of the evaporator grid 70. The shroud 72 has laterally extending wing portions 76 and 78 projecting from each end of the evaporator grid 70. A bib portion 80 of the shroud 72 is disposed beneath the bottom edge of the evaporator grid 70 and contains integral projecting deflector fins 82. Each deflector fin 82 is aligned with the center of a column of pockets in the evaporator grid 70.

The shroud 72 also includes an inclined roof 86 disposed above the evaporator grid 70. A water distributor 88 is attached to the shroud wings 76 and 78 above the roof 86. As shown in FIGS. 8, 9, 11 and 12, the distributor 88 has a floor 90 with a central well 92 at one edge. Spaced upright barriers 94*a* and 94*b* extend from the floor 90 beyond the well 92. A second series of spaced barriers 96*a*, 96*b*, et. sec. extend between the barriers 94*a* and 94*b* and a rear edge 98 of the floor 90. Water deposited in the well 92 will be directed by the barriers 94 and 96 to flow uniformly over the rear edge 98 and on to the inclined roof 86. The water will thereafter flow over the roof 86 of the shroud 72, and into and over the surfaces of the pockets in evaporator grid 70. As shown in FIGS. 8–12, uniform distribution of the water is further ensured by a guide 100 that has a top opening 102 that receives an end of a water tube 103 and a cylindrical wall section 104 that fits around a portion of the well 92. The guide 100 fixes the water tube 103 at the middle of the distributor 88. The water tube is also secured in place by a rivet 106 connection to the top of the cabinet 32.

An icemaker evaporator 108 is attached to the rear wall 74 of the evaporator grid 70. The icemaker evaporator 108 is a part of the refrigeration system shown schematically in FIGS. 13–20, which also includes the refrigerator evaporator 44 mentioned above.

Generally, the refrigerator evaporator 44 has an outlet line 110 which passes through an accumulator 112 to a compressor 114. The accumulator 112 functions in part as a reservoir for liquid refrigerant so that only gas is fed to the compressor 114. A discharge line 116 connected to the outlet of the compressor 114 is connected to the inlet of a condenser 118 having an outlet line 120 connected to a dryer 122. A capillary tube 124 leads from the dryer 122 to the inlet of the icemaker evaporator 108. A bypass line 126, having a hot gas bypass valve 128, runs between the compressor discharge line 116 and an inlet of the icemaker evaporator 108. The icemaker evaporator 108 has a branched outlet line 130 connected to an inlet of the refrigerator evaporator 44 and to the accumulator 112, such that the evaporators 44 and 108 are connected in series with the refrigerator evaporator 44 receiving refrigerant passing from the ice maker evaporator 108. A refrigerator valve 132 controls communication between the icemaker evaporator 108 outlet and the refrigerator evaporator 44 inlet and a refrigerator bypass valve 134 controls communication between the icemaker evaporator 108 outlet and the accumulator 112. All of the valves 128, 132 and 134 are electronically controlled, preferably solenoid type valves. Valves 132 and 134 are interlocked by a double throw relay which requires one of these valves 132 and 134 to always be open while preventing both from being concurrently open or closed.

As is known, the compressor 114 draws refrigerant from the refrigerator evaporator 44 (and ice maker evaporator 108) and accumulator 112 and discharges the refrigerant under increased pressure and temperature to the condenser 118. The hot, pre-condensed refrigerant gas entering the condenser 118 is cooled by air circulated by a fan 136. As the temperature of the refrigerant drops under substantially constant pressure, the refrigerant in the condenser 118 liquefies. The smaller diameter capillary tube 124 maintains the high pressure in the condenser 118 and at the compressor outlet while providing substantially reduced pressure in the ice maker evaporator 108. The substantially reduced pressure in the ice maker evaporator 108 results in a large temperature drop and subsequent absorption of heat by the ice maker evaporator 108 (and also possibly the refrigerator evaporator 44).

As mentioned, the refrigeration system includes a hot gas bypass valve 128 disposed in bypass line 126 between the outlet of the compressor 114 (via discharge line 116) and the inlet of the icemaker evaporator 108. When the hot gas bypass valve 128 is opened, hot pre-condensed refrigerant will enter the icemaker evaporator 108, thereby heating the evaporator grid 70. Such a hot gas bypass system is described in U.S. Pat. No. 5,065,584 issued Nov. 19, 1991, for "Hot Gas Bypass Defrosting System".

Figure 4:
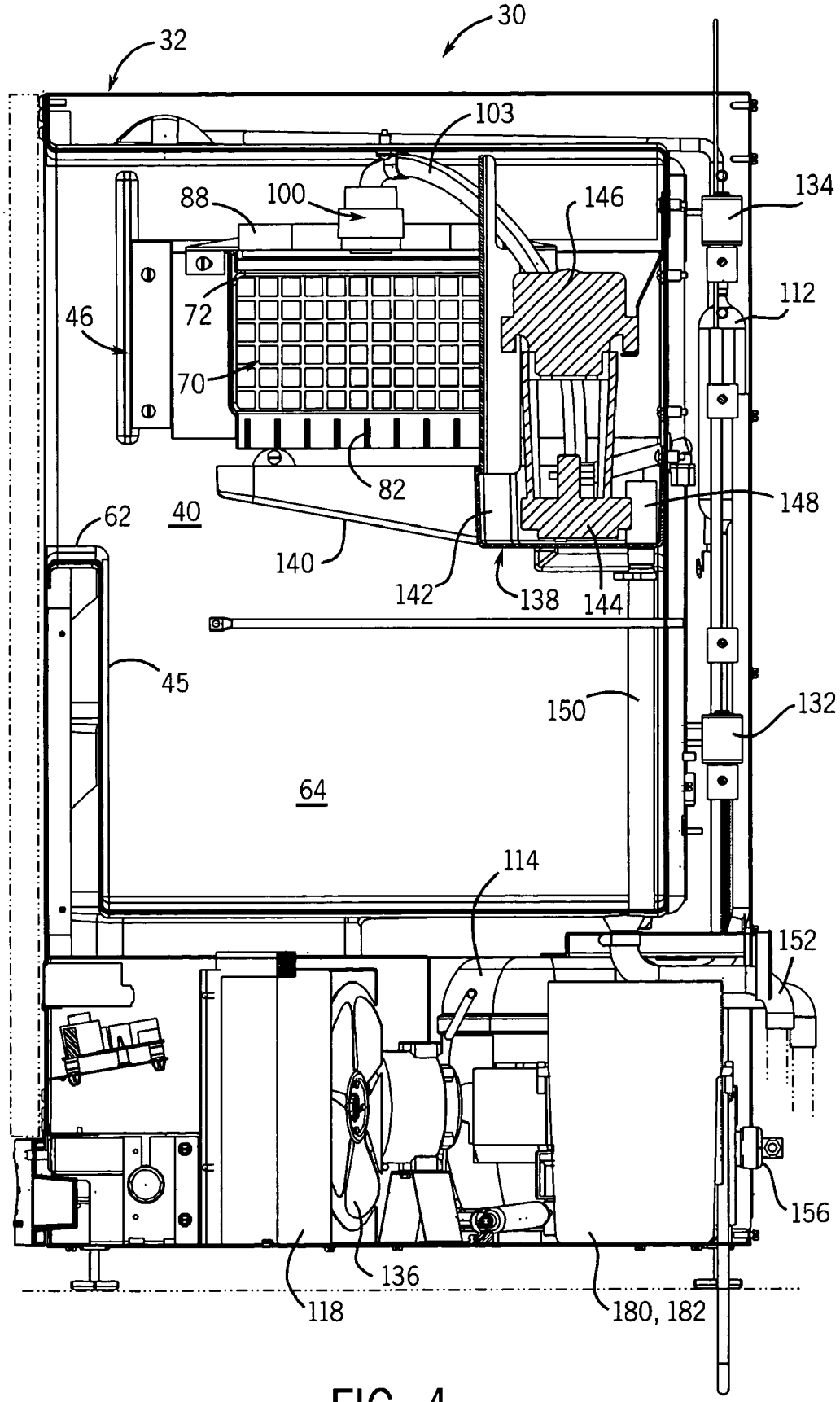
FIG. 4 is a side view sectional view showing the ice maker section of the refrigerator.

The compressor 114, condenser 118, and fan 136 are located at the bottom of the cabinet 32 beneath the insulated portion, as shown in FIGS. 4 and 5A–5B.

Referring to FIGS. 4 and 8, a water sump 138 has a trough portion 140 extending beneath the evaporator grid 70 of the clear ice maker assembly 46. The bottom of the trough portion 140 slopes downwardly to the level of a well 142 in which the inlet 144 of a water pump 146 is mounted. The outlet of the water pump 146 is connected to the well 92 in the distributor 88. A removable stand pipe 148 extends into the sump 138 and leads to an overflow pipe 150. The overflow pipe 150 opens to a drain 152 in the bottom of the bin area of the insert 45 within the ice section of the cabinet 32. Thus, water from the sump 138 and any melted ice within the ice bin 64 can drain through the drain 152. The drain 152 can be connected to a drain in the home plumbing, or it may lead to an overflow collector 182 (discussed below) in the space beneath the insulated portion of the cabinet 32. Fresh water from an external source may be provided periodically to the sump 138 through a water fill valve 156 (see FIGS. 6 and 13).

In general operation, water from the sump 138 is pumped by the pump 146 to the distributor 88 which delivers a cascade of water over the surfaces of the evaporator grid 70. When the icemaker evaporator 108 is connected to receive liquefied refrigerant from the condenser 118, the water cascading over the surface of the evaporator grid 70 will freeze forming cubes of clear ice in the pockets. The pure water freezes first and impurities and trapped air in the water will either escape or be left in suspension in the flowing water. Once the ice cubes are formed, the hot gas bypass valve 126 is opened and hot refrigerant is delivered to the icemaker evaporator 108, thereby warming the surface of the evaporator grid 70 until the ice cubes dislodge from the evaporator grid 70. The dislodged ice cubes will fall into the bin 64 and are directed away from the trough portion 140 of the sump 138 by the fins 82. As mentioned, not all water cascading over the surface of the evaporator grid 70 will freeze. The excess water is collected in the trough 140 and returned to the well 142 where it is recirculated to the distributor 88 by the pump 146. During ice harvest (after each freezing cycle), a charge of fresh water is delivered to the sump by the water fill valve 156 to dilute the water and flush impurities through the overflow pipe 148 and out the drain.

Although not shown, the combination refrigerator and clear ice maker 30 includes an electrical system for controlling the operation of the compressor 114, solenoids for valves 128, 132 and 134, the condenser fan 136, the water pump 146, and a solenoid that controls the fresh water inlet valve 156. The operation of the motors and solenoids are controlled by a microprocessor based control that operates by programmed logic and in response to sensor and user input. The programmed logic, for example, provides a timed shut down cycle (e.g., four minutes) following every operation of the compressor. The control circuitry is also designed with various built-in technician diagnostic capabilities to provide on board testing of electrical subsystems.

The electric system includes three sensors, or thermistors including a bin thermistor (not shown) disposed near the upper side of the ice bin 64, a refrigerator thermistor (not shown) disposed in the refrigerator section of the cabinet 32, and a liquid line thermistor (not shown) disposed in the outlet line 120 of the condenser 118. The thermistors are conventional parts commercially available, for example, from Royal Philips Electronics of Amsterdam, The Netherlands. An optional overflow circuit (described below) also provides feedback to the control as to the status of the drain. A user control 160 disposed in a front panel at the lower ice maker side of the cabinet 32 and a toggle switch 162 located at the cabinet front grille 161 provide input from the user. The toggle switch 162 is a three-position switch for turning the system to "on", "off" or "clean" modes. The user control 160 (see FIG. 21) has an LED display 164 for displaying the actual and desired or "set" temperatures and three LED indicator lights A, B and C described below. The user control 160 also includes "set temp" 170, "warmer" 172 and "cooler" 174 push buttons.

Figure 14:
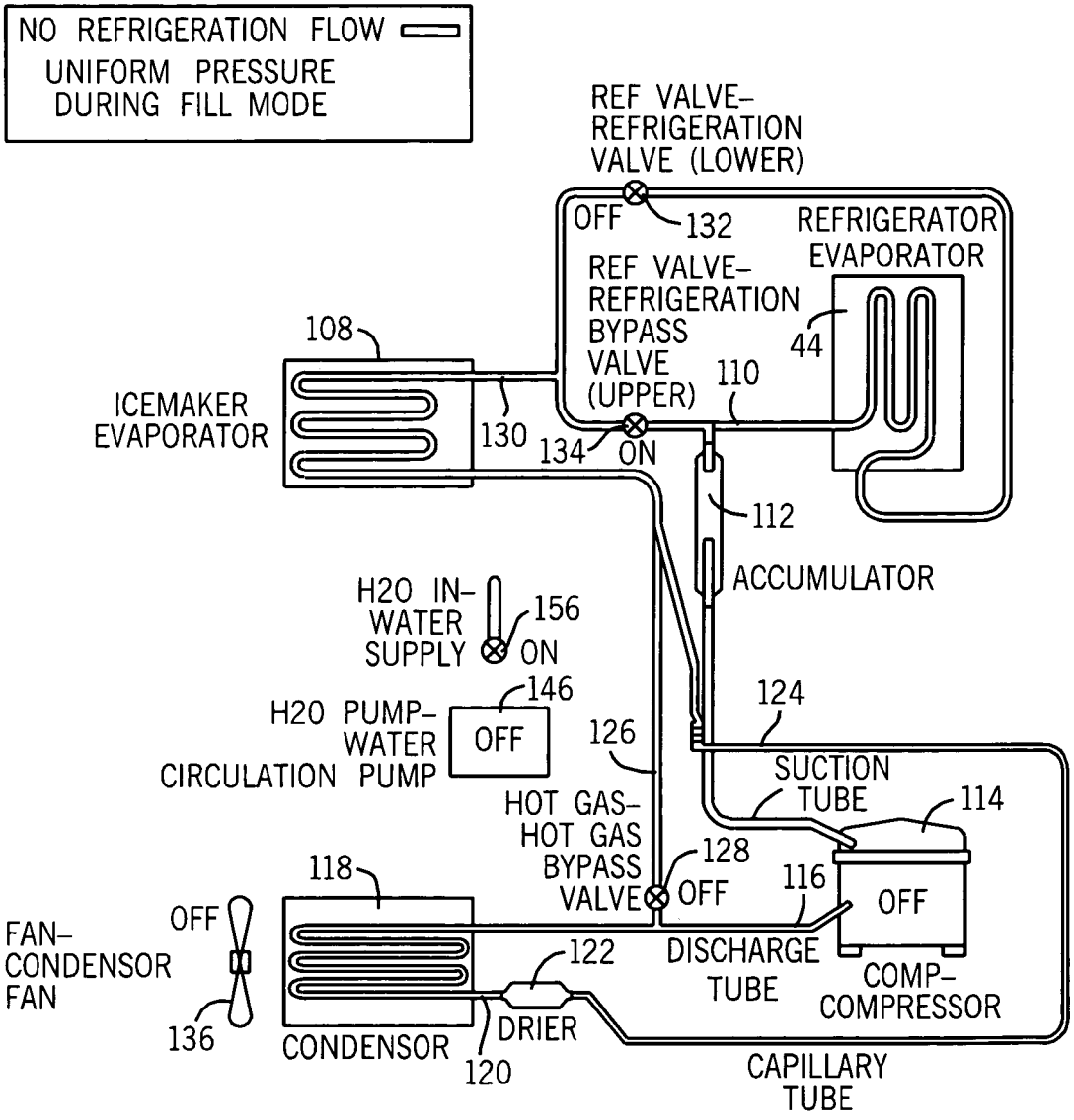
FIG. 14 is a schematic diagram of the refrigeration system in a water fill mode when no refrigeration is required.
Figure 15:
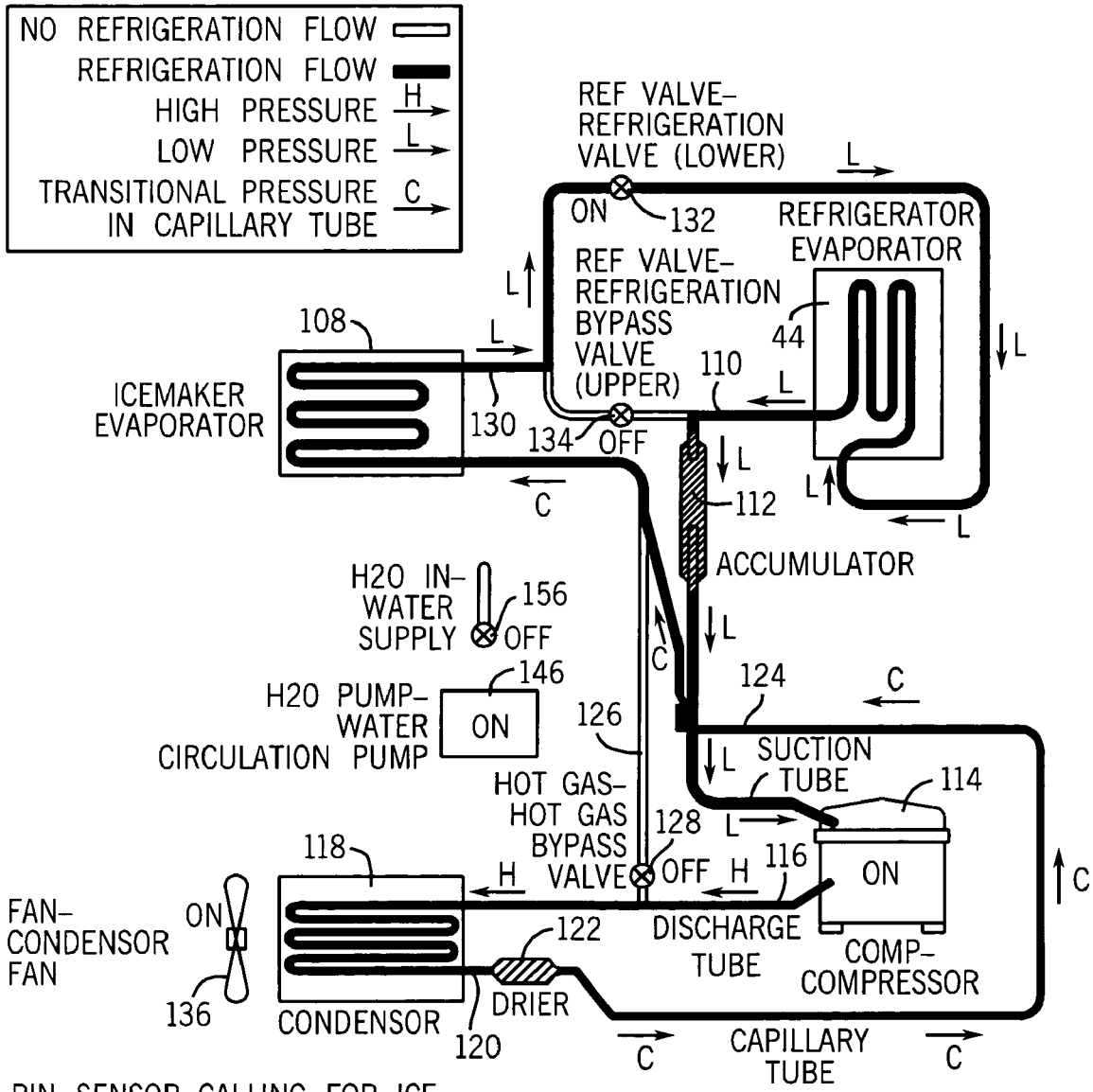
FIG. 15 is a schematic diagram of the refrigeration system when in an ice making and refrigeration mode.
Figure 16:
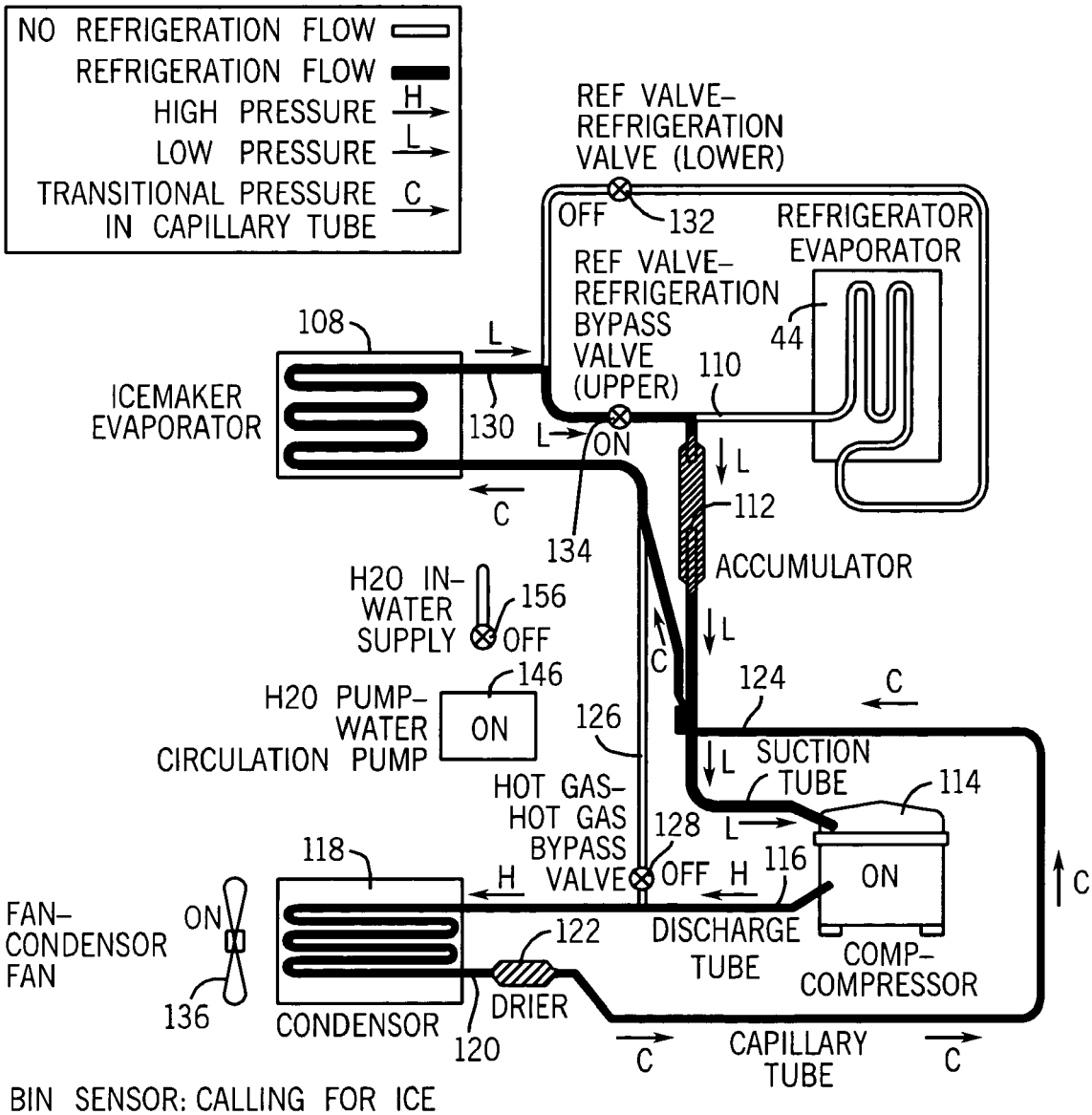
FIG. 16 is a schematic diagram of the refrigeration system when in an ice making only mode.

With reference to FIGS. 13–20, the operation of the combination unit 30 will now be described. On initial start-up or restarting with the bin thermistor closed, the toggle switch 162 is placed into the "on" position to energize the unit. Depending on whether the refrigerator section is warmer than the temperature set point of the control, which defaults at 38° F., the refrigeration system will operate as shown in either FIG. 13 or FIG. 14. FIG. 13 illustrates the normal operation at initial startup since ordinarily the refrigerator section will be warmer than desired. In this case, turning the toggle switch to on will energize the solenoids for the refrigerator valve 132 and the water inlet valve 156. This will also energize the compressor 114 and the condenser fan 136 to being circulating refrigerant through both refrigerator 44 and the icemaker 108 evaporators. This initial water fill mode will continue for a period of time, such as three minutes, regardless of the status of the bin and refrigerator thermistors, in a preferred form of the control logic. As shown in FIG. 14, if the refrigerator section is at or below the set temperature at startup, for example, because of recent operation, cold product stored in the refrigerator section, or cold ambient temperatures, then the water fill mode will run as shown in FIG. 14 when the toggle switch 162 is turned to on, in which only the solenoids for the water fill valve 156 and the refrigerator bypass valve 134 are energized for the set period of time.

Figure 17:
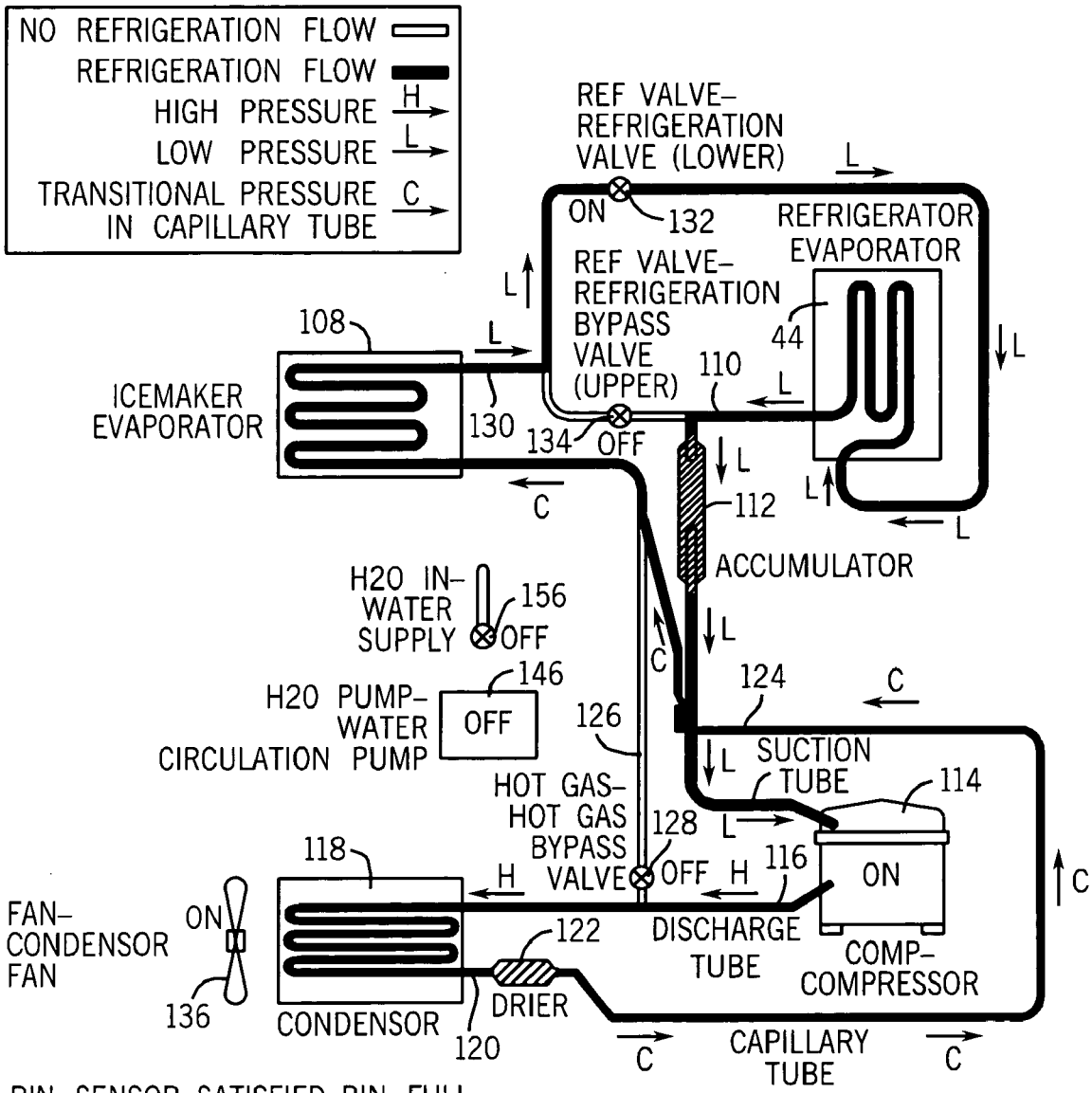
FIG. 17 is a schematic diagram of the refrigeration system when in a refrigeration only mode.

Once the initial water fill cycle is complete, the unit will enter one of three modes: ice making and refrigeration mode (FIG. 15), ice making only mode (FIG. 16), or refrigeration only mode (FIG. 17). Again, because at initial startup the refrigerator section is ordinarily warmer than the set temperature and there is no ice in the bin 64, the unit will normally enter the ice making and refrigeration mode illustrated in FIG. 15. As shown, here the bin thermistor is calling for ice and the refrigerator thermistor is calling for cooling. In this mode, the compressor 114, condenser fan 136 and water pump 146 are energized as is the solenoid for the refrigerator valve 132. Refrigerant will circulate through both of the refrigerator 44 and icemaker 108 evaporators to cool the refrigerator section and the evaporator grid 70 of the clear ice maker assembly.

After a certain predetermined period of time into this cycle, such as four minutes, a reading of the liquid refrigerant temperature sensed by the line thermistor is taken. This temperature reading will determine the remaining length of time for the ice making portion of the cycle and may also be used to set or adjust the duration of the ice harvest cycle. The higher the temperature of the liquid refrigerant, the longer the ice making cycle. For example, if the liquid refrigerant temperature is 80° F., the total freeze time will be about 14 minutes. If the sensed temperature is 100° F., the total freeze time will be about 22 minutes. At a temperature of 120° F., the freeze time will be about 30 minutes.

The control is preferably programmed so that once an ice making cycle has been initiated, the cycle will continue to completion through ice harvest regardless of thermistor readings. This prevents the ice making cycle from terminating prematurely thereby ensuring that full-sized ice cubes are formed. At initial startup the control is also preferably programmed to complete a first set of ice cubes without regard to the refrigerator thermistor reading. Once that initial ice is made, and following subsequent ice harvest cycles, the control will check the refrigerator thermistor reading to determine if the refrigerator section is above the higher of a predetermined refrigerator limit temperature, such as 42° F. or the set temperature. If so, the unit will enter refrigeration only mode, illustrated in FIG. 17, even if the ice bin thermistor is calling for more ice. Note that after the first ice cycle, ice making is preferably suspended until the refrigerator section reaches 42° F., or some user set higher temperature. In the refrigeration only mode, the compressor 114 and the condenser fan 136 are energized and the water pump 146 is de-energized while the refrigerator valve 132 remains energized. The unit will continue in this mode until the refrigerator section reaches the limit temperature (42° F.) or a higher user set temperature following the first ice cycle. At that point, if the temperature in the refrigerator section is lower than the limit temperature, then the ice making and refrigeration mode will resume, unless the temperature in the refrigerator is below the set temperature in which case the unit will enter the ice making only mode illustrated in FIG. 16, assuming in both cases that the bin thermistor is calling for ice. In the ice making only mode the compressor 114, condenser fan 136, water pump 146 and the solenoid for the refrigerator bypass valve 134 are energized. Because of the interlocking architecture, opening of the refrigerator bypass valve 134 closes the refrigerator valve 132 so that no refrigerant passes through the refrigerator evaporator 44. A water fill cycle, as illustrated in FIGS. 13 or 14 (depending on conditions), will be initiated after the ice bin thermistor has been satisfied, when the ice bin has been filled and then again calls for ice. This can occur when the refrigerator side is cooling (FIG. 13) or not (FIG. 14). If the refrigerator side is cooling when the fill cycle is initiated, the control is programmed to maintain refrigerator cooling until the water fill cycle is completed, regardless of the reading of the refrigerator thermistor.

Figure 18:
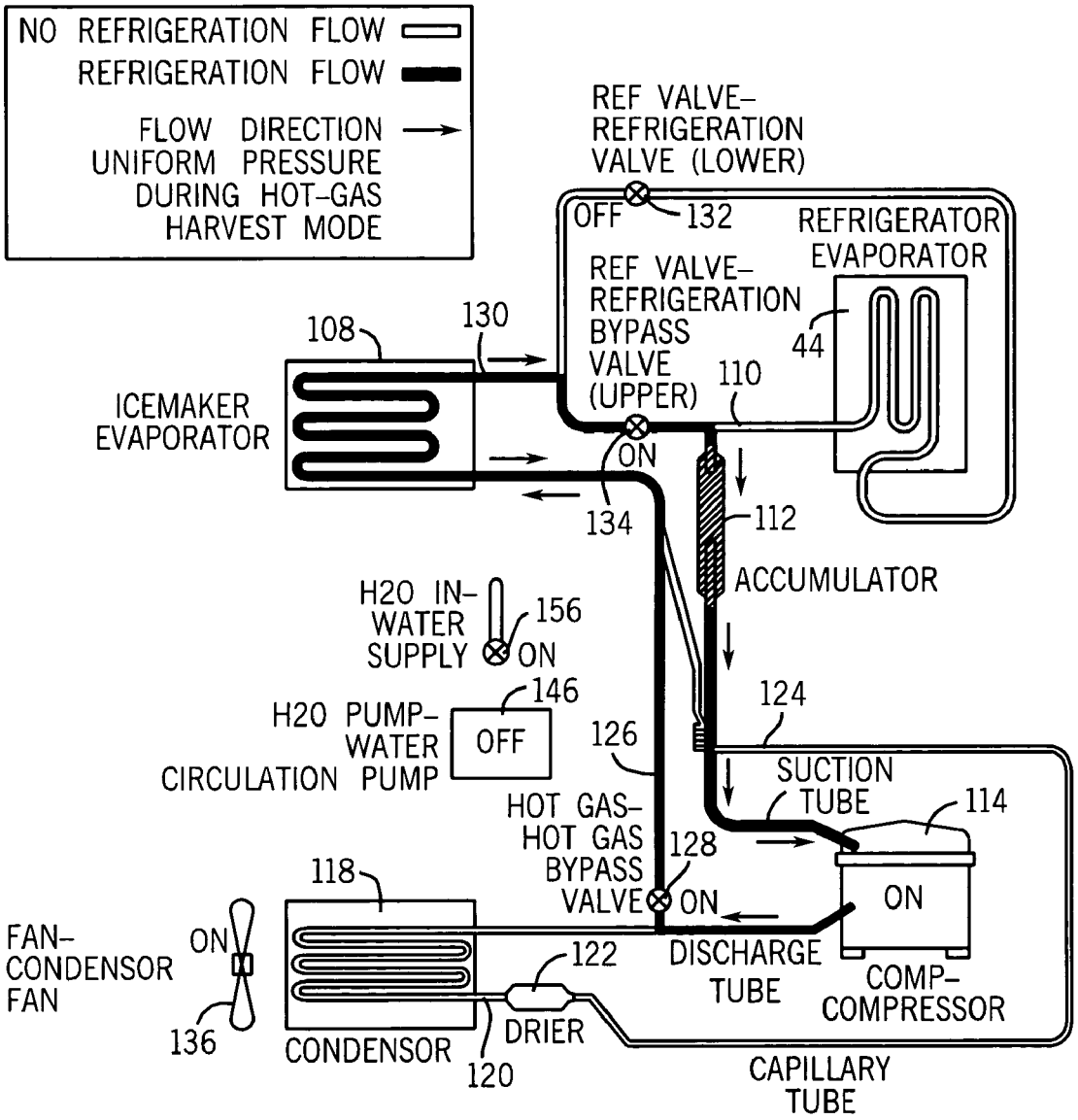
FIG. 18 is a schematic diagram of the refrigeration system when in an ice harvest (no refrigeration) mode.

When the ice making cycle is completed, the unit enters ice harvest mode, as illustrated in FIG. 18, in which the compressor 114 remains energized while the water pump 146 and condenser fan 136 are de-energized and the solenoids for the hot gas bypass valve 128 and the water inlet valve 156 are energized. The solenoid for the refrigerator bypass valve 134 is also energized so that no cooling of the refrigerator section is possible during ice harvest. The hot refrigerant gas flowing through the icemaker evaporator 108 will loosen the ice formed in the pockets of the evaporator grid 70 so that the ice can fall into the ice bin 64. As mentioned, the length of the ice harvest cycle can be dependent upon the reading of the liquid line thermistor. The length of the harvest cycle would thus be adjusted inversely based upon the sensed temperature. The harvest cycle can also be made constant for a range of temperatures or entirely independent of the liquid line thermistor. A typically harvest cycle lasts approximately 2–3 minutes.

If the bin thermistor calls for additional ice at the conclusion of the ice harvest cycle, the control enters to a new ice cycle with the compressor, water pump, and condenser fan all energized and with the hot gas and water inlet solenoids de-energized. Once the bin thermistor opens, when the bin is full of ice, the ice making and harvesting cycle will stop until the ice level is decreased.

Figure 19:
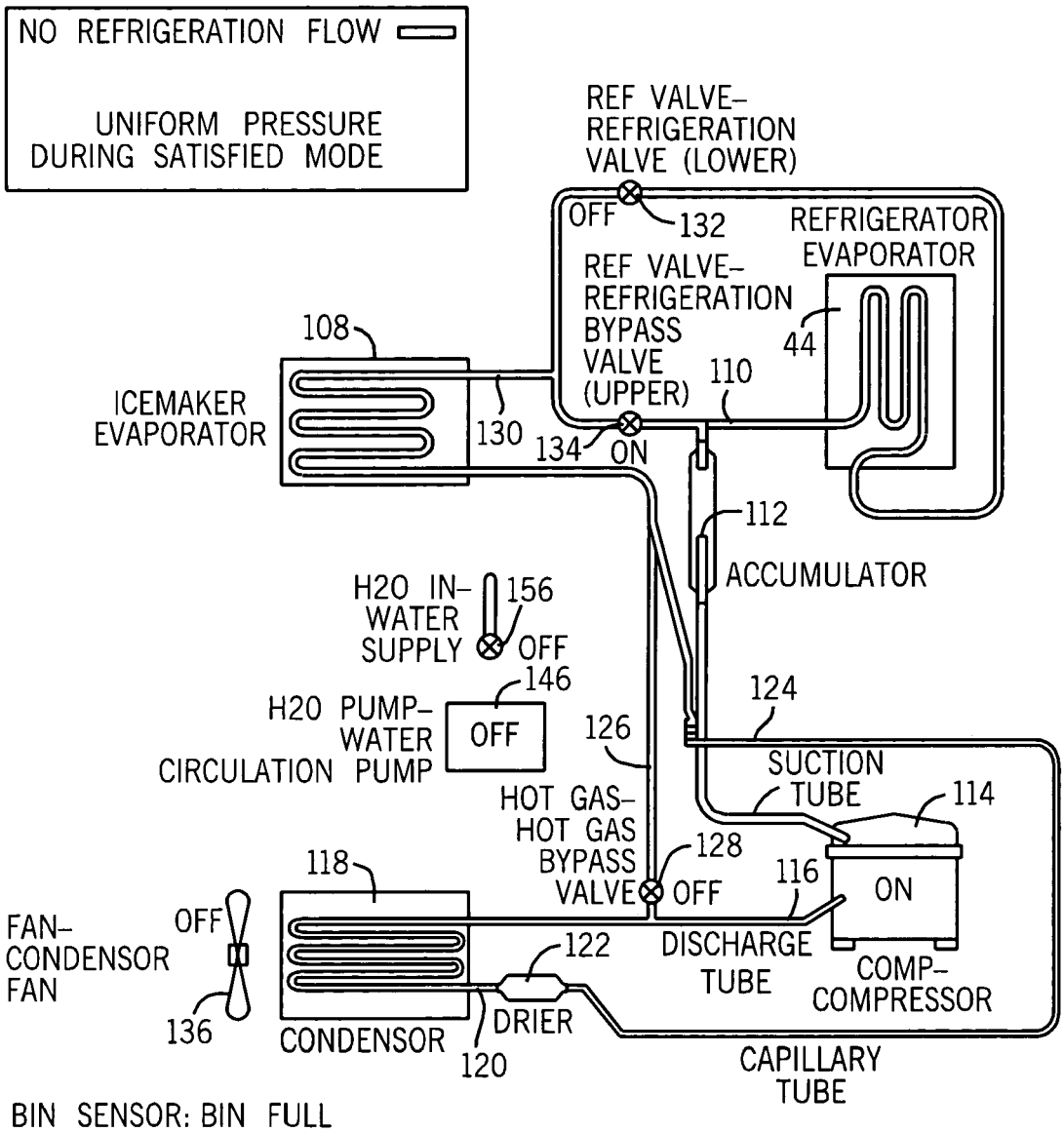
FIG. 19 is a schematic diagram of the refrigeration system when all sub-systems are satisfied.

When both the refrigerator and bin thermistors have been satisfied, the unit enters the "all satisfied" mode illustrated in FIG. 19. Here, all systems and solenoids are de-energized, with the exception that the refrigerator bypass valve is energized. It should be noted that the control is preferably programmed with a two degree (F) set point tolerance (or four degree temperature differential) for the refrigerator thermistor to smooth out the refrigeration on and off cycles at or near the set temperature. For example, if the set temperature is 38° F., the refrigerator section will be cooled to 36° F. and will not re-initiate cooling until the refrigerator thermistor reads 40° F.

Figure 20:
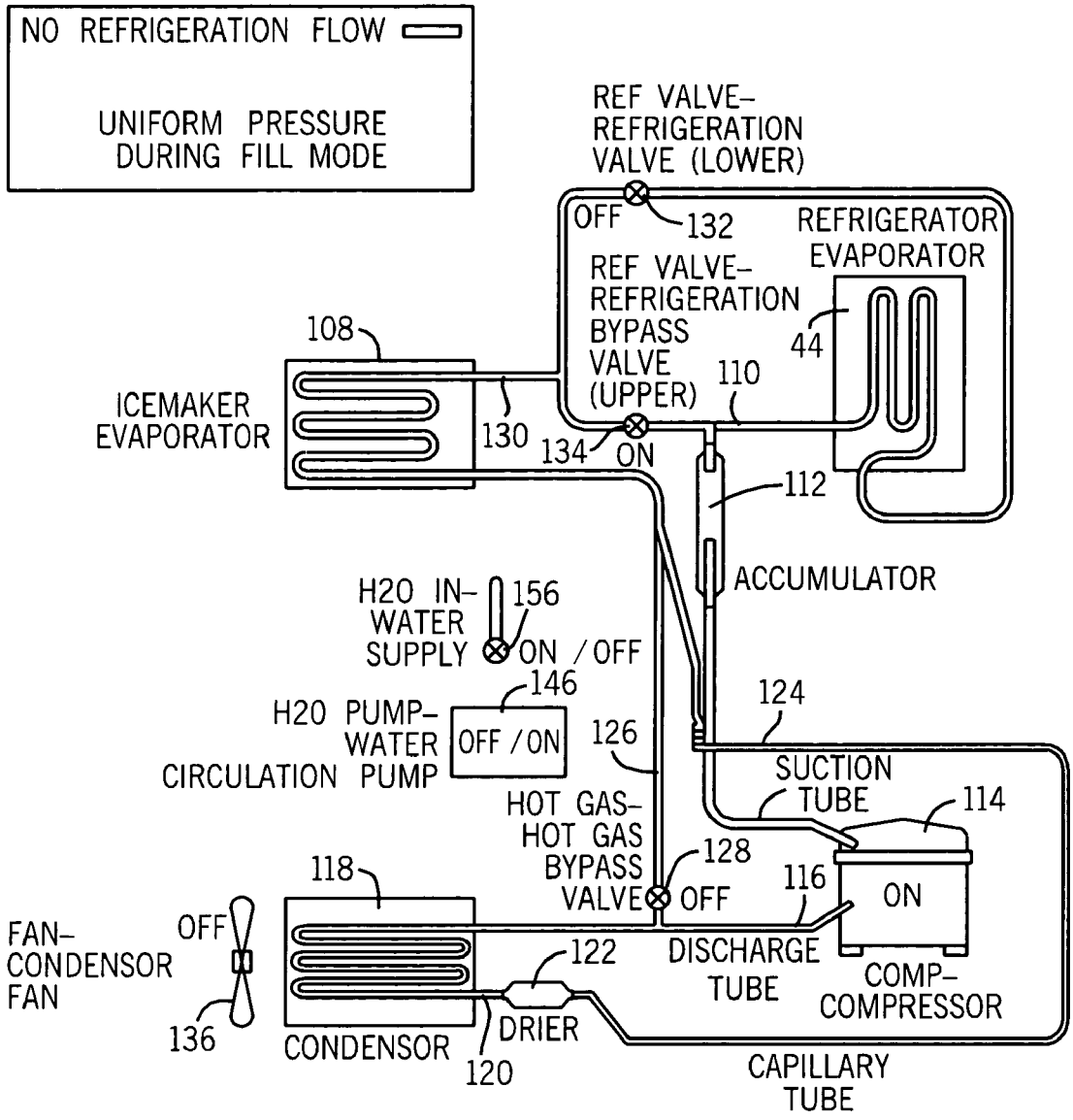
FIG. 20 is a schematic diagram of the refrigeration system when in a cleaning (no refrigeration) mode.

The unit can also enter a clean mode, by moving the toggle switch 162 to a "clean" position, in which the control cycles through programmed wash, fill, and rinse cycles for cleaning the icemaker evaporator 108 and evaporator grid 70. As illustrated in FIG. 20, in the clean mode the compressor 114 and condenser fan 136 are de-energized so that there is no refrigerant flow through the evaporators and the water pump 146 and solenoid for the water inlet valve 156 are energized and de-energized in alternating fashion to provide a charge of fresh water to the water pump which pumps the water over the ice maker grid. If desired, a cleaning solution can be added manually to the water and pumped through the clear ice maker assembly to improve cleaning.

The refrigerator evaporator 44 remains frost free by clearing itself periodically. Since the refrigerator thermistor is not directly on the refrigerator evaporator, the control is programmed to run a thirty minute refrigerator off cycle for every twelve hours of clock time. In this case, the refrigerator section will not be cooled even if the refrigerator thermistor calls for cooling, however, the ice maker can operate as normal based on the bin thermistor reading.

Figure 21:
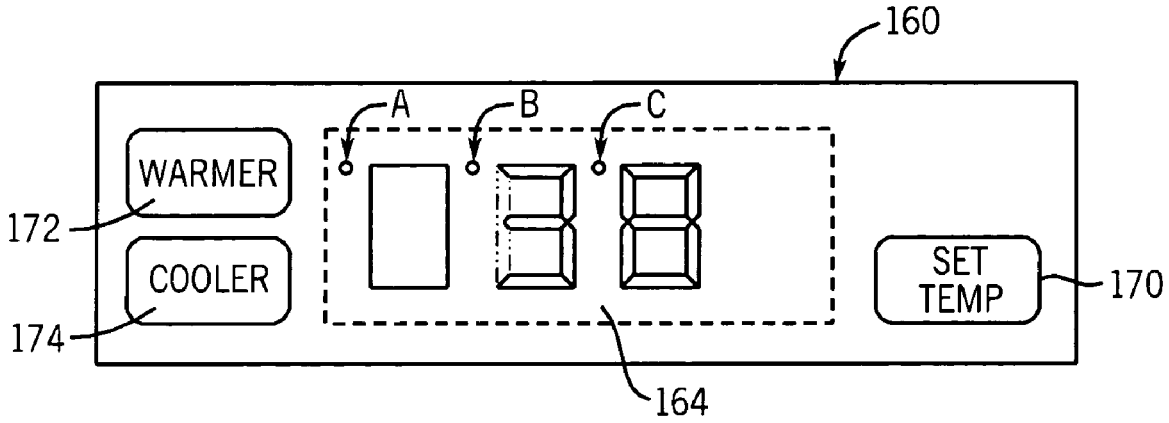
FIG. 21 is a diagram of the user control and interface for the refrigeration system.

Referring now to FIG. 21, the user control 160 displays the set temperature of the refrigerator section on the LED display 164, by pressing and the warmer 172 button the actual temperature can be shown on the display 164, the indicator light A will illuminate solid at this time as well. The temperature of the refrigerator section can be adjusted by depressing the set temp button 170 momentarily and depressing the warmer 172 and cooler 174 buttons until the desired temperature is displayed. The displayed temperature will flash for a time period, such as 10 seconds, and the new set temperature will be stored in memory and the set mode will be exited and then the display will stop flashing.

The three dot-like LED indicator lights 166–168 shown in the display window as either off, solid or flashing depending on the indicator light and status of the unit. These indicator lights give the user and the service technician feedback of the current status of the unit as well as prior or current error conditions, as summarized in Table 1 below.

TABLE 1

LED indications

| LED | Status | Meaning |
|---|---|---|
| A | Solid | Actual refrigerator temperature displayed |
| | Flashing | Not applicable |
| B | Solid | Service menu - will exit after wait 10 seconds |
| | Flashing | Open thermistor - call for service |
| C | Solid | Service menu - will exit after 10 seconds |
| | Flashing | Drain pump is blocked - check install and drain line |

As mentioned, indicator light A will illuminate solid when the actual temperature of the refrigerator section is being displayed. This indicator light has no other function and does not flash. Indicator lights B and C illuminate solid when a service menu is activated. Depressing the cooler button 174 will illuminate indicator light B and the reading of the liquid line thermistor will be displayed. Keeping the cooler button 174 depressed will illuminate indicator light C and the bin thermistor reading will be displayed. By continuing to depress the cooler button 174, the display will alternate between the liquid line and bin temperature readings.

In the event that any one of the thermistor readings is out of the acceptable ranges, indicator light B will flash to indicate an error condition. If either the liquid line reading or the bin reading is out of range, the ice maker will shut down, but allow the refrigerator side to continue cooling, if necessary. If the refrigerator reading is out of range, the refrigerator side will shut down (by energizing refrigerator bypass valve 134) while allowing the ice maker side to continue operation. When the errant reading returns to an acceptable value, the unit will reinitiate operation of the affected system. The indicator light B will remain flashing, even after normal operation conditions have resumed, to provide the user and service technician with an indication that an error condition has occurred. This is to help for the technician diagnose the source of the problem, which in the case of a high liquid line temperature reading may be due to heavy loading, restricted airflow, or an unclean condenser, for example.

The indicator light C will flash when an error condition has occurred in the drain line when an optional drain pump 180 and overflow collector 182 (see FIGS. 5A and 5D) are instilled, as needed in applications where a gravity assisted drain line cannot be accessed. In a preferred form, the drain pump 180 is actuated by a float controlled switch to periodically empty the collector 182 (and sump). A second float controlling another switch (not shown) is located in the collector 182 at a higher level that when tripped shuts down the ice maker (without effecting operation of the refrigerator section), by de-energizing or preventing energizing of the water pump and water fill valve. Tripping the second switch indicates that the drain pump 180 is not working or that there has been a blockage in the drain line. At this point, the indicator light C will begin flashing, and like indicator light B, the control is programmed to keep indicator light C flashing after normal operation has resumed to aid in service diagnostics. Both flashing indicator lights will remain flashing until power to the unit is disrupted, for example, by tripping a circuit breaker or unplugging the plug from the electrical outlet.

It should be appreciated that merely a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

We claim:

1. A refrigerator with clear ice making capability, comprising:

a cabinet defining an interior refrigerator chamber and an interior ice maker chamber isolated from the refrigerator chamber by a partition wall;

a clear ice maker mechanism disposed in the ice maker chamber and including an evaporator plate defining a plurality of pockets over which water cascades and in which clear ice pieces are formed;

a refrigeration system including an ice maker evaporator disposed in the ice maker chamber adjacent the evaporator plate and a refrigerator evaporator disposed in the refrigerator chamber, the evaporators being coupled to a compressor receiving return refrigerant from the evaporators and to a condenser coupled to the compressor.

2. The clear ice making refrigerator of claim 1, wherein the evaporators are connected in series.

3. The clear ice making refrigerator of claim 2, wherein the refrigerator evaporator receives refrigerant passing through the ice maker evaporator.

4. The clear ice making refrigerator of claim 3, wherein the refrigeration system further includes a refrigerator valve controlling flow of refrigerant from the ice maker evaporator to the refrigerator evaporator.

5. The clear ice making refrigerator of claim 3, wherein the refrigeration system further includes a capillary tube coupling an outlet side of the condenser to an inlet side of the ice maker evaporator.

6. The clear ice making refrigerator of claim 5, wherein the refrigeration system further includes a drier at the outlet side of the condenser and an accumulator coupled between an outlet side of the refrigerator evaporator and an inlet side of the compressor.

7. The clear ice making refrigerator of claim 3, wherein the refrigeration system further includes a water system including:

a water sump mounted in the ice maker chamber beneath the ice maker evaporator plate;

a water pump disposed in the sump to circulate water from the sump back to the evaporator plate; and an overflow mechanism coupling the sump to a drain.

8. The clear ice making refrigerator of claim 7, wherein the ice maker mechanism includes a water distributor disposed above the evaporator plate distributing water over the plurality of pockets of the evaporator plate.

9. The clear ice making refrigerator of claim 8, wherein the distributor receives water from a water tube.

10. The clear ice making refrigerator of claim 9, wherein the water tube is mounted to the distributor by a tube retainer.

11. The clear ice making refrigerator of claim 7, wherein the overflow mechanism includes a drain pump and an overflow collector having a first float operating a switch to activate the drain pump.

12. The clear ice making refrigerator of claim 1, wherein the cabinet has a front opening leading to the ice maker chamber and the refrigerator chamber that is closed by a door hinged to the cabinet along one side having a seal that when the door is closed extends along walls of the cabinet defining the front opening and along the partition wall dividing the refrigerator chamber from the ice maker chamber.

13. The ice making refrigerator of claim 1, wherein the evaporator plate has a plurality of spaced vertical members and a plurality of spaced horizontal members intersecting the vertical members at right angles to define the pockets.

14. The ice making refrigerator of claim 13, wherein the horizontal members slope downwardly from a rear edge to a front edge at an oblique angle.

15. A refrigerator with clear ice making capability, comprising:

a cabinet defining an interior refrigerator chamber and an interior ice maker chamber isolated from the refrigerator chamber by a partition wall;

a clear ice maker mechanism disposed in the ice maker chamber and including an evaporator plate defining a plurality of pockets over which water cascades and in which clear ice pieces are formed;

a refrigeration system including an ice maker evaporator disposed in the ice maker chamber adjacent the evaporator plate and a refrigerator evaporator disposed in the refrigerator chamber, the evaporators being coupled to a compressor receiving return refrigerant from the evaporators and to a condenser coupled to the compressor;

wherein the evaporators are connected in series;

wherein the refrigerator evaporator receives refrigerant passing through the ice maker evaporator;

wherein the refrigeration system further includes a refrigerator valve controlling flow of refrigerant from the ice maker evaporator to the refrigerator evaporator;

wherein the refrigeration system further includes a bypass valve controlling flow of refrigerant from the ice maker to the compressor when the primary valve is closed.

16. The clear ice making refrigerator of claim 15, wherein the primary and bypass valves are controlled so that during operation of the refrigerator at least one of the valves is open without both of the valves being open or closed concurrently.

17. A refrigerator with clear ice making capability, comprising:

a cabinet defining an interior refrigerator chamber and an interior ice maker chamber isolated from the refrigerator chamber by a partition wall;

a clear ice maker mechanism disposed in the ice maker chamber and including an evaporator plate defining a plurality of pockets over which water cascades and in which clear ice pieces are formed;

a refrigeration system including an ice maker evaporator disposed in the ice maker chamber adjacent the evaporator plate and a refrigerator evaporator disposed in the refrigerator chamber, the evaporators being coupled to a compressor receiving return refrigerant from the evaporators and to a condenser coupled to the compressor;

wherein the evaporators are connected in series;

wherein the refrigerator evaporator receives refrigerant passing through the ice maker evaporator;

wherein the refrigeration system further includes a bypass valve disposed between an outlet side of the compressor and the inlet side of the ice maker evaporator so that when open hot refrigerant is routed to the ice maker evaporator.

18. A refrigerator with clear ice making capability, comprising:

a cabinet defining an interior refrigerator chamber and an interior ice maker chamber isolated from the refrigerator chamber by a partition wall;

a clear ice maker mechanism disposed in the ice maker chamber and including an evaporator plate defining a plurality of pockets over which water cascades and in which clear ice pieces are formed;

a refrigeration system including an ice maker evaporator disposed in the ice maker chamber adjacent the evaporator plate and a refrigerator evaporator disposed in the refrigerator chamber, the evaporators being coupled to a compressor receiving return refrigerant from the evaporators and to a condenser coupled to the compressor;

wherein the evaporators are connected in series;

wherein the refrigerator evaporator receives refrigerant passing through the ice maker evaporator;

wherein the refrigeration system further includes a water system including a water sump mounted in the ice maker chamber beneath the ice maker evaporator plate, a water pump disposed in the sump to circulate water from the sump back to the evaporator plate, and an overflow mechanism coupling the sump to a drain;

wherein the ice maker mechanism includes a water distributor disposed above the evaporator plate distributing water over the plurality of pockets of the evaporator plate;

wherein the distributor receives water from a water tube;

wherein the water tube is mounted to the distributor by a tube retainer;

wherein the tube retainer is located at a center of the distributor and has an opening receiving the water tube and an inverted partial cup section mating with a partial cup section of the distributor.

19. A refrigerator with clear ice making capability, comprising:

a cabinet defining an interior refrigerator chamber and an interior ice maker chamber isolated from the refrigerator chamber by a partition wall;

a clear ice maker mechanism disposed in the ice maker chamber and including an evaporator plate defining a plurality of pockets over which water cascades and in which clear ice pieces are formed;

a refrigeration system including an ice maker evaporator disposed in the ice maker chamber adjacent the evaporator plate and a refrigerator evaporator disposed in the refrigerator chamber, the evaporators being coupled to a compressor receiving return refrigerant from the evaporators and to a condenser coupled to the compressor;

wherein the evaporators are connected in series;

wherein the refrigerator evaporator receives refrigerant passing through the ice maker evaporator;

wherein the refrigeration system further includes a water system including a water sump mounted in the ice maker chamber beneath the ice maker evaporator plate, a water pump disposed in the sump to circulate water from the sump back to the evaporator plate, and an overflow mechanism coupling the sump to a drain, wherein the overflow mechanism includes a drain pump and an overflow collector having a first float operating a switch to activate the drain pump wherein the overflow collector includes a second float disposed vertically above the first float used to operate a second switch for signaling the controller to shut down the ice maker mechanism until the second float has returned to a normal position.

20. The clear ice making refrigerator of claim 19, wherein an indicator light is provided which is activated by the second float.

21. The clear ice making refrigerator of claim 20, wherein the indicator light stays on until power is removed to the refrigerator.

22. A refrigerator with clear ice making capability, comprising:

a cabinet defining an interior refrigerator chamber and an interior ice maker chamber isolated from the refrigerator chamber by a partition wall;

a clear ice maker mechanism disposed in the ice maker chamber and including an evaporator plate defining a plurality of pockets over which water cascades and in which clear ice pieces are formed;

a refrigeration system including an ice maker evaporator disposed in the ice maker chamber adjacent the evaporator plate and a refrigerator evaporator disposed in the refrigerator chamber, the evaporators being coupled to a compressor receiving return refrigerant from the evaporators and to a condenser coupled to the compressor;

wherein the cabinet has a front opening leading to the ice maker chamber and the refrigerator chamber that is closed by a door hinged to the cabinet along one side having a seal that when the door is closed extends along walls of the cabinet defining the front opening and along the partition wall dividing the refrigerator chamber from the ice maker chamber;

wherein a cross member of the seal extends between parallel segments of the seal at an intermediate location between end segments of the seal selected to seal an opening to an insulated body in the ice section when the door is closed.

23. A combination refrigerator and ice maker unit having a cabinet defining an interior refrigerator chamber and an interior ice maker chamber in which is disposed a clear ice maker having an evaporator plate in which ice cubes are formed, the unit has an electronically controlled refrigeration system, comprising:

an ice maker evaporator disposed in the ice maker chamber adjacent the evaporator plate;

a refrigerator evaporator disposed in the refrigerator chamber;

a compressor disposed in the cabinet external to the ice maker and refrigerator chambers receiving refrigerant from one of the evaporators via a suction tube;

a condenser disposed in the cabinet external to the ice maker and refrigerator chambers receiving compressed refrigerant from the compressor via a discharge tube and being coupled to the ice maker evaporator via a capillary tube;

a refrigerator valve disposed in a line between an outlet side of the ice maker evaporator and an inlet side of the refrigerator evaporator so that when open the refrigerator evaporator is in fluid communication with the ice maker evaporator and when closed the refrigerator evaporator is closed from the ice maker evaporator; and a refrigerator bypass valve disposed in a line between outlet sides of the evaporators and an inlet side of the compressor so that when open the ice maker is in fluid communication with the compressor and when closed the refrigerator evaporator is in fluid communication with the compressor;

wherein one of the refrigerator valve and refrigerator bypass valve is open during operation of the refrigerator without both being open concurrently such that when the refrigerator bypass valve is open no refrigerant passes from the ice maker evaporator to the refrigerator evaporator.

24. The combination unit of claim 23, wherein the refrigeration system further includes a hot gas bypass valve disposed in a line joining the discharge tube to an inlet of the ice maker evaporator such that when closed an outlet side of the compressor is in fluid communication with an inlet side of the condenser and when open the outlet side of the compressor is in fluid communication with an inlet side of the ice maker evaporator such that no refrigerant passes from the compressor to the condenser.

25. The combination unit of claim 24, wherein the refrigeration system is electronically controlled to operate in one of at least four modes including:

(a) a dual ice making and refrigeration mode in which water is supplied to the ice maker evaporator plate and refrigerant is supplied to the ice maker evaporator and the refrigerator evaporator;

(b) a refrigeration only mode in which refrigerant is supplied to the ice maker evaporator and the refrigerator evaporator without supplying water to the ice maker evaporator plate;

(c) an ice making only mode in which water is supplied to the ice maker evaporator plate and refrigerant is supplied to the ice maker evaporator and not to the refrigerator evaporator; and (d) an ice harvest mode in which pre-condensed refrigerant is supplied to the ice maker evaporator.

26. The combination unit of claim 25, wherein the refrigeration system can be electronically controlled to operate in a fifth cleaning mode in which no refrigerant is supplied to either the ice maker evaporator or the refrigerator evaporator and water is supplied to the ice maker evaporator plate.

27. The combination unit of claim 24, further including a water system including:

a water sump mounted in the ice maker chamber beneath the ice maker evaporator plate;

a water pump disposed in the sump to circulate water from the sump back to the evaporator plate; and an overflow mechanism coupling the sump to a drain.

* * * * *